US009567788B2

(12) United States Patent
DeBoer

(10) Patent No.: US 9,567,788 B2
(45) **Date of Patent: *Feb. 14, 2017**

(54) WINDOW SASH COUNTERBALANCE WITH INDEPENDENTLY OPERABLE SASHES

(71) Applicant: Marvin Lumber and Cedar Company, Warroad, MN (US)

(72) Inventor: Nathan H. DeBoer, Salol, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/827,945

(22) Filed: Aug. 17, 2015

(65) Prior Publication Data

US 2016/0002968 A1 Jan. 7, 2016

Related U.S. Application Data

(63) Continuation of application No. 13/836,306, filed on Mar. 15, 2013, now Pat. No. 9,109,386.

(60) Provisional application No. 61/732,701, filed on Dec. 3, 2012.

(51) Int. Cl.

| | |
|---|---|
| ***E05F 11/04*** | (2006.01) |
| ***E06B 3/44*** | (2006.01) |
| *E05D 13/00* | (2006.01) |

(52) U.S. Cl.

CPC ..... *E05F 11/04* (2013.01); *E05D 13/1207* (2013.01); *E05D 13/14* (2013.01); *E06B 3/4415* (2013.01); *E05D 13/10* (2013.01)

(58) Field of Classification Search

CPC ..... E05F 11/04; E05D 13/14; E05D 13/1207; E05D 13/10; E06B 3/4415

See application file for complete search history.

(56) References Cited

U.S. PATENT DOCUMENTS

| | | | | |
|---|---|---|---|---|
| 543,848 | A | 8/1895 | Cayce | |
| 644,949 | A * | 3/1900 | Spinks | E05F 17/00 49/121 |
| 1,480,994 | A | 1/1924 | Church | |
| 1,678,444 | A | 7/1928 | Roedl | |
| 2,249,132 | A | 7/1941 | Haslam | |

(Continued)

OTHER PUBLICATIONS

"U.S. Appl. No. 13/836,306, Non Final Office Action mailed Sep. 5, 2014", 22 pgs.

(Continued)

*Primary Examiner* — Gregory Strimbu

(74) *Attorney, Agent, or Firm* — Schwegman Lundberg & Woessner, P.A.

(57) ABSTRACT

A window, with a hybrid sash counterbalance and assist mechanism, includes a frame having upper and lower sashes slidable within the frame. A sash coupling element extends between the upper and lower sashes. The hybrid sash counterbalance and assist mechanism is coupled with the sash coupling element. The window with the hybrid sash counterbalance and assist mechanism is operable in a sash counterbalance mode and in an independent sash movement mode. In the sash counterbalance mode, movement of the upper or lower sash causes converse movement of the lower or upper sash through the sash coupling element. In the independent sash movement mode, one of the upper and lower sashes is held static while the other of the lower or upper sashes is moved.

14 Claims, 14 Drawing Sheets

(56) References Cited

U.S. PATENT DOCUMENTS

| | | | | |
|---|---|---|---|---|
| 2,276,881 | A | 3/1942 | Schimmel | |
| 2,428,976 | A | 10/1947 | Mecklanburg | |
| 2,553,738 | A * | 5/1951 | Anderson | E06B 3/2605 16/193 |
| 2,883,715 | A | 4/1959 | Walker | |
| 2,921,348 | A | 1/1960 | Nardulli | |
| 3,475,864 | A | 11/1969 | Wood | |
| 4,170,090 | A | 10/1979 | Wood | |
| 4,238,907 | A | 12/1980 | Swan | |
| 4,413,445 | A | 11/1983 | Trout | |
| 4,420,907 | A | 12/1983 | Swan | |
| 4,503,641 | A | 3/1985 | Swan | |
| 4,586,291 | A | 5/1986 | Swan | |
| 4,760,622 | A | 8/1988 | Rohrman | |
| 5,445,364 | A | 8/1995 | Tibbals, Jr. | |
| 6,243,988 | B1 | 6/2001 | Salice | |
| 7,117,636 | B2 * | 10/2006 | Gann | E05D 13/14 49/116 |
| 9,109,386 | B2 | 8/2015 | DeBoer | |
| 2009/0188075 | A1 | 7/2009 | Baker | |
| 2014/0150346 | A1 | 6/2014 | Deboer | |

OTHER PUBLICATIONS

"U.S. Appl. No. 13/836,306, Notice of Allowance mailed Mar. 18, 2015", 14 pgs.

"U.S. Appl. No. 13/836,306, Notice of Allowance mailed Apr. 10, 2015", 17 pgs.

"U.S. Appl. No. 13/836,306, Response filed Dec. 5, 2014 to Non Final Office Action mailed Sep. 5, 2014", 26 pgs.

"Canadian Application Serial No. 2,832,198, Office Action mailed Oct. 9, 2015", 3 pgs.

"Canadian Application Serial No. 2,832,198, Response filed Apr. 8, 2016 to Office Action mailed Oct. 9, 2015", 13 pgs.

* cited by examiner

WINDOW SASH COUNTERBALANCE WITH INDEPENDENTLY OPERABLE SASHES

CROSS-REFERENCE TO RELATED PATENT DOCUMENTS

This application is a continuation of U.S. patent application Ser. No. 13/836,306, entitled "Window Sash Counterbalance with Independently Operable Sashes", filed on Mar. 15, 2013, which claims the benefit of priority under 35 U.S.C. §119(e) to U.S. Provisional Patent Application Ser. No. 61/732,701, entitled "Window Sash Counterbalance with Independently Operable Sashes", filed on Dec. 3, 2012, which are herein incorporated by reference in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Lumber and Cedar Company, d/b/a Marvin Windows and Doors, Warroad, Minn. All Rights Reserved.

TECHNICAL FIELD

This document pertains generally, but not by way of limitation, to fenestration units including double hung fenestration units.

BACKGROUND

Counterbalanced windows provide assistance for lifting one or more sashes. For instance, user assistance may be needed to raise some larger window sashes (e.g., some sashes weigh fifty pounds or more), or to assist the elderly, or other users. Counterbalanced windows include individual counterbalance mechanisms and sash-based counterbalance mechanisms.

One example of a balance tube type counterbalance mechanism is provided in Trout, U.S. Pat. No. 4,413,445, entitled "Spring-Stretch-Reducing Window Sash Balance." In this example, a sash is coupled with a sash cable that extends around a pulley and a travelling pulley. The sash cable is anchored to a sash guide. As with a conventional double hung window, each of the sashes are separately operable, and a user is not able to operate both of the sashes through movement of a single sash. For instance, opening (e.g., raising) the lower sash does not cause opening (e.g., lowering) of the upper sash. For especially large (e.g., tall or wide) windows, such an arrangement may cause additional difficulty for the user as operation of the lower sash does not correspondingly operate the upper sash. Instead, in the case of especially tall windows, a user may have to use a step ladder, or other elevating tool, to reach the upper sash to lower it. Further, it may be difficult to apply leverage to the upper sash at its raised location, for instance from a ladder or while reaching from a standing position and on the balls of one's feet.

Another example of counterbalanced window is shown in Schimmel, U.S. Pat. No. 2,276,881, entitled "Counter-Balanced Window Sash." In this example, a window includes two sashes that are coupled together using a chain. The chain is wrapped around a pulley. With this mechanism, raising the lower sash lowers the upper sash, and conversely, lowering the upper sash raises the lower sash. This counterbalance arrangement prohibits independent opening and closing of the sashes. Stated another way, as the lower sash is raised to open the window, the upper sash lowers to provide openings at both the top and the bottom of the window frame. Because the movement of one sash results in opposed movement of the other sash, a maximized egress opening (e.g., with the lower sash raised and the upper sash remaining in the elevated and original closed position) is not possible.

OVERVIEW

The present inventor has recognized, among other things, that a problem to be solved can include providing sash-based counterbalancing, having cooperative sash movement, with independently movable sashes. Sash-based counterbalancing of double hung window sashes allows a user to operate a single sash and at the same time also operate the opposed sash in a converse manner, for instance, as the lower sash is raised the upper sash is lowered. Additionally, counterbalancing allows the user to operate the sashes with reduced operating force. It is also desirable to have a converse arrangement with sashes that open and close independently, for instance to provide a maximized egress opening or an opening that is limited to the area between the top of the sashes and the header of the frame (upper end of the frame).

In an example, the present subject matter can provide a solution to these problems by providing a window assembly including a hybrid sash counterbalance and assist mechanism that allows for counterbalancing operation with two sashes, and independent operation of the sashes as desired, for instance to maximize an opening of the window (e.g., for egress purposes).

The hybrid sash counterbalance assist mechanism examples provided herein are usable in both counterbalancing and independent operation modes, and transition between the modes with retention and release of one of the sashes (e.g., with engagement by a user, latch, or the like).

In an example, the hybrid sash counterbalance and assist mechanism includes an intermediate pulley coupled with a spring bias mechanism, including, but not limited to, a block and tackle system with a spring. The friction of the block and tackle is provided to retain the intermediate pulley in place during counterbalancing operation, for example, by attenuating and enhancing the spring tension with raising and lowering of a sash, respectively. Further, during independent operation, the tension applied by the hybrid sash counterbalance and assist mechanism to a sash coupling element extending between the sashes assists in raising of one or both of the sashes.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
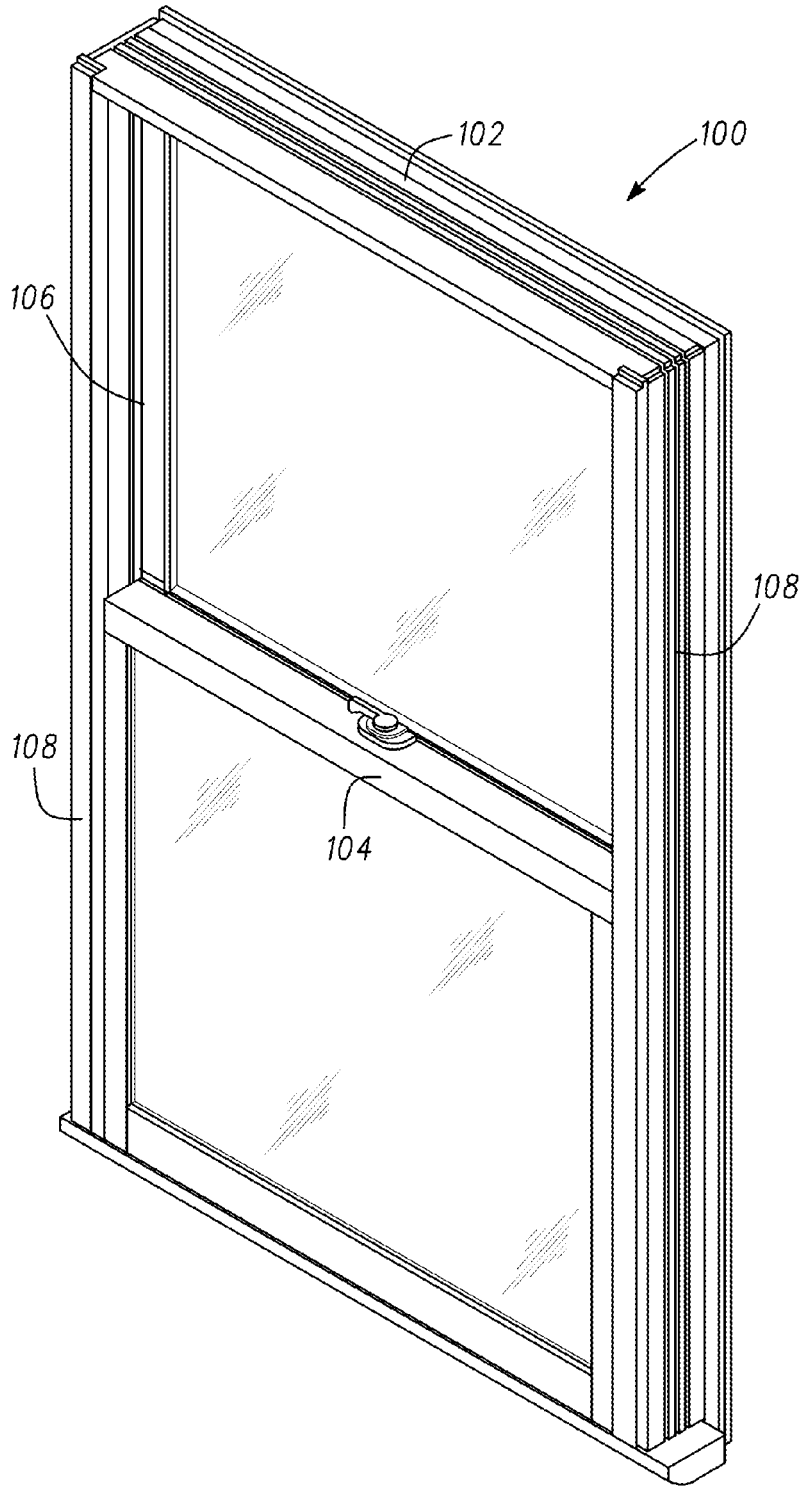
FIG. 1 is a perspective view showing one example of a double hung window.

FIG. 1 is a perspective view showing one example of a window such as a double hung window 100. The double hung window 100 includes a frame 102 having first and second sashes 104, 106 slidably positioned within the frame 102, and the frame 102 includes opposed jambs 108. As will be described in detail, the window 100 includes one or more counterbalance and assist mechanisms, such as the counterbalance and assist mechanism 200 shown in FIG. 2A, as well as in other figures herein.

In an example, the counterbalance and assist mechanism 200 provides multi-modal operation of the window 100, including a counterbalance mode and an independent operating mode. For instance, in the counterbalance mode, the counterbalance and assist mechanism 200 provides for a counterbalance operation of the first and second sashes 104, 106. As the first sash is raised and lowered, the second sash 106 acts as a counterbalance and correspondingly lowers and raises with movement opposing the first sash 104, such as to assist with movement of the sashes.

The counterbalance and assist mechanism 200 can transition from the counterbalance mode to one or more independent operating modes wherein one of the sashes, such as the first or the second sash 104, 106 is held static (e.g., immobile) while the other of the two sashes 104, 106 moves independently. That is, while the first or second sash 104, 106 is static, the other sash 104, 106 moves independently to accordingly permit the window 100 to open, for instance into a maximized egress configuration (e.g., where the first and second sashes 104, 106 are both positioned in a raised configuration). In an independent operation mode, the counterbalance and assist mechanism 200, as described in further detail herein, continues to provide user assistance for raising and lowering of the first and second sashes 104, 106. The counterbalance and assist mechanism 200 accordingly retains one of the sashes, for instance the lower first sash 104, in a raised configuration, and concurrently retains the other sash, for instance the second sash 106, in a raised configuration to maintain a maximized opening of the window 100.

Figure 2A:
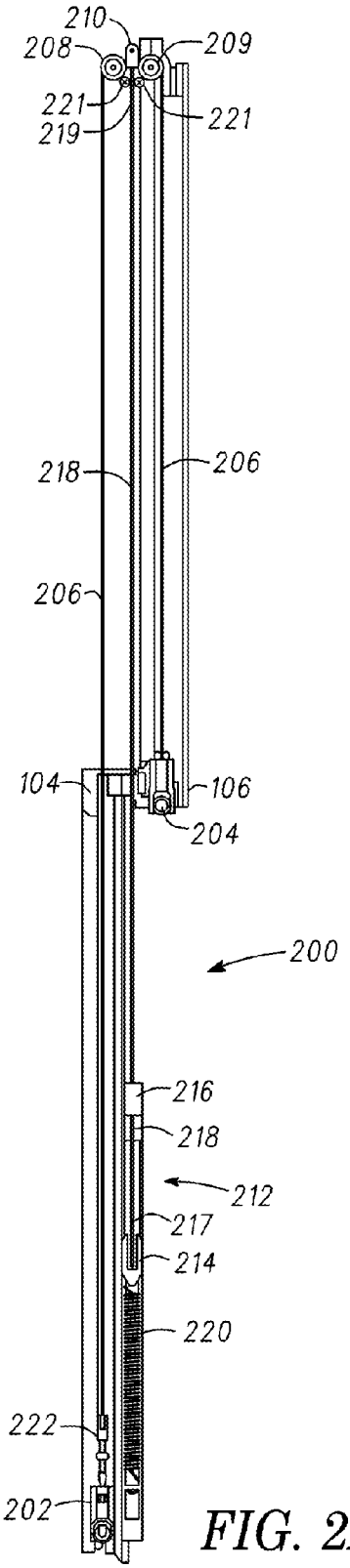
FIG. 2A is an exposed a cross sectional view of one example of a counterbalanced double hung window with independently operable sashes in a closed position.

Referring now to FIG. 2A, an example of the counterbalance and assist mechanism 200 is shown. In an example, the counterbalance and assist mechanism 200 is operable in at least two modes, and the counterbalance and assist mechanism 200 is able to transition between the at least two modes according to static positioning of one or more of the sashes, movement of one sash relative to the other (e.g., outside of normal counterbalance movements), and the like. In the example shown in FIG. 2A, the counterbalance and assist mechanism 200 can transition between at least a counterbalance mode and at least one independent operating mode. In an independent operating mode, for instance where the first sash 104 is raised relative to the second sash 106, the counterbalance and assist mechanism 200 continues to provide assistance to lifting of the first sash 104, for instance by pulling a pulley coupled with sash coupling elements, such as the coupling element 206, by way of a blocking tackle 212 and spring 220.

Referring again to FIG. 2A, the counterbalance and assist mechanism 200 is shown positioned relatively between the first and second sashes 104, 106. The sash coupling element 206 is coupled between the first and second sashes 104, 106 for instance by anchors 202, 204, associated with each of the sashes 104, 106 respectively. In an example, the anchors 202, 204, include respective tilt clutches to facilitate tilting of the sashes 104, 106 as desired by an operator. The sash coupling element 206 includes, but is not limited to a cable element, chain, ribbon, or the like. As shown in FIG. 2A, the sash coupling element 206 extends between the anchors 202, 204, for instance, across at least first and second guide pulleys 208, 209, (for instance, guides) positioned near the upper portion of the frame (e.g., near the upper portion of the frame 102 shown in FIG. 1). As further shown in FIG. 2A, the sash coupling element 206 can extend in series around arcuate portions of each of the first and second guide pulleys 208, 209, as well as through an intermediate guide pulley 210. Stated another way, the sash coupling element 206 includes multiple cord lengths that extend between each of the sashes 104, 106 the first and second guide pulleys 208, 209, and the intermediate guide pulley 210, in both the counterbalance mode and the independent operating mode. In the counterbalance mode, the cord lengths of the sash coupling element 206 are substantially similar. A first cord length extends linearly between the first sash 104 and the first guide pulley 208, and a second cord length extends linearly between the second sash 106 and the second guide pulley 209.

A third cord length extends substantially linearly between the first and second guide pulleys 208, 209, and in one example, deflects a minimal amount through engagement with the intermediate pulley 210.

As further shown in FIG. 2A, a flexible tackle element 218, such as a cable element, chain, ribbon, or the like, extends from the intermediate guide pulley 210 (e.g., for instance from a second tackle element end 219) to a block and tackle 212 coupled at an opposed end of the frame (e.g., for instance with a sill of the frame 102). In the example, the block and tackle 212 includes at least a first block 214 and a second block 216. Each of the first and second blocks 214, 216, includes one or more tracks configured to provide a mechanical advantage to the counterbalance and assist mechanism 200 (for instance, to assist in lifting and lowering of the sashes 104, 106). As shown, a first tackle element end 217 is coupled with the first block 214, and a second tackle element end 219 of the flexible tackle element 218 is coupled with the intermediate pulley 210. A spring 220 extends from the first block 214 and is coupled with another portion of the frame (e.g., with a bottom portion of one of the jambs 108 or sill of the frame 102). The block and tackle 212, in combination with the tension applied to the intermediate pulley 210 by the spring 220, maintains the pulley 210 and the sash coupling element 206 in tension whether the counterbalance and assist mechanism 200 is in the counterbalance mode or an independent operation mode. The relationship between the window operating modes and the mechanical advantage provided by the block and tackle 212 and the spring 220, among other elements, are further described herein.

Figure 2B:
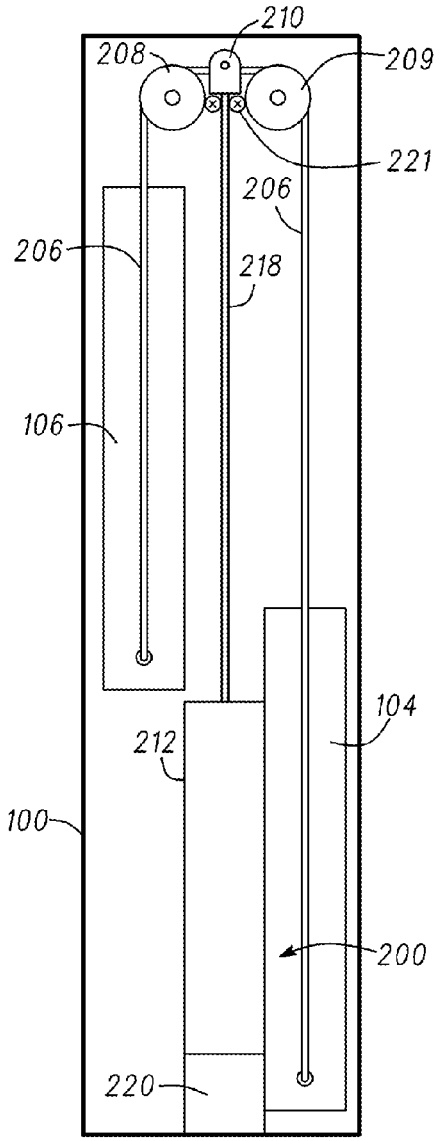
FIG. 2B is a schematic view of one example of a counterbalanced double hung window with independently operable sashes in a closed position.

In an example, one or more retainers 221 are provided in line with the intermediate pulley 210. The one or more retainers can include, but are not limited to, pins, fasteners, stops, bars, and the like. As shown in FIGS. 2A and 2B, the retainers 221 are positioned near the intermediate pulley 210 (e.g., beneath the intermediate pulley 210) in the counterbalance mode. In the configuration shown, the retainers 221 hold the intermediate pulley 210 in the locations shown, and correspondingly inhibit or prevent movement of the intermediate pulley 210. That is, when a user moves the pins into position below the intermediate pulley 210, independent operation of the sashes 104, 106 is substantially prohibited. In another example, the one or more retainers 221 extend through the intermediate pulley 210 and thereby retain the pulley at a static location.

In an example, a tension adjustor 222 is coupled with one or both of the anchors 202, 204. The tension adjustor 222 includes, in an example, a rotatable eyelet or other feature that allows the sash coupling element 206 to be tensioned in the field, such as may be needed during installation or maintenance over the lifetime of operation of the window 100. For example, as the spring 220 loses its elasticity over time, or a replacement spring is installed in place of an original spring, the tension adjustor 222 can be used to tension the spring 220. In the counterbalance mode, the tension adjustor 222 thereby allows the sash coupling element 206 to maintain the counterbalance and assist mechanism 200 function by maintaining a nominal tension to facilitate the counterbalance operation. In the independent operating mode, the tension adjustor 222 permits the intermediate pulley 210 to move toward the spring 220 at the opposed end of the frame 102. That is, the counterbalance and assist mechanism 200, even with the exchange of the spring 220 and relaxation of the mechanism 200 over the lifetime of the window 100, can maintain tension and thereby avoid slack in the sash coupling element 206 through operation of the tension adjustor 222, or the replacement of the spring 220.

Referring now to FIG. 2B, the arrangement of FIG. 2A is shown with the first and second sashes 104, 106 in a closed configuration. In this example, the first sash 104 is lowered relative to the second sash 106 to provide a closed configuration of the window 100. As shown, the sash coupling element 206 extends between each of the first and second sashes 104, 106 across the first and second guide pulleys 208, 209. Additionally, the intermediate guide pulley 210 is shown in a fully extended state, with the sash coupling element 206 extending between the guide pulleys 208, 209, in a substantially linear arrangement. In the example of FIG. 2B, the first and second sashes 104, 106 are in a counterbalance mode where the elevating, or raising, the first sash 104 correspondingly lowers the second sash 106, and lowering of the second sash 106 correspondingly elevates, or raises, the first sash 104. The block and tackle 212 and the spring 220 are shown in schematic view, and provide tension to the intermediate pulley 210 to accordingly transition the window system comprising the first and second sashes 104, 106 between the counterbalance mode and an independent operating mode wherein one or both of the sashes is movable independently relative to the other.

Figure 3A:
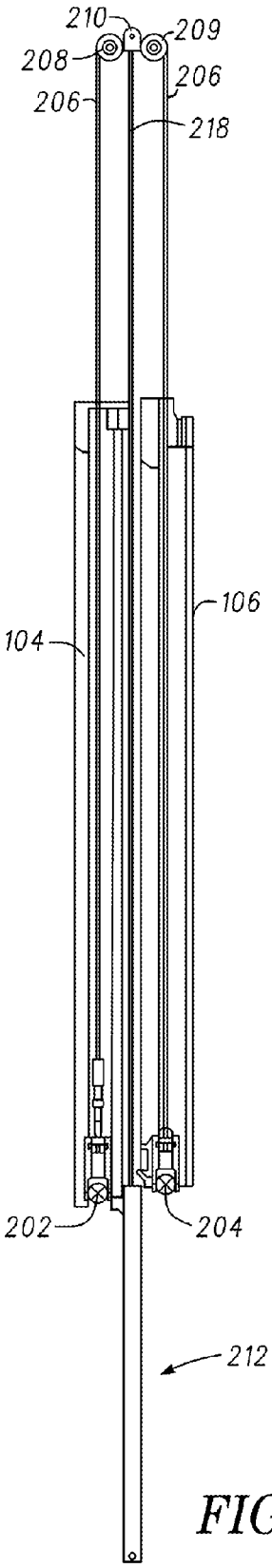
FIG. 3A is an exposed a cross sectional view showing the counterbalanced double hung window of FIG. 2 in an open position according to cooperation of the sashes.
Figure 3B:
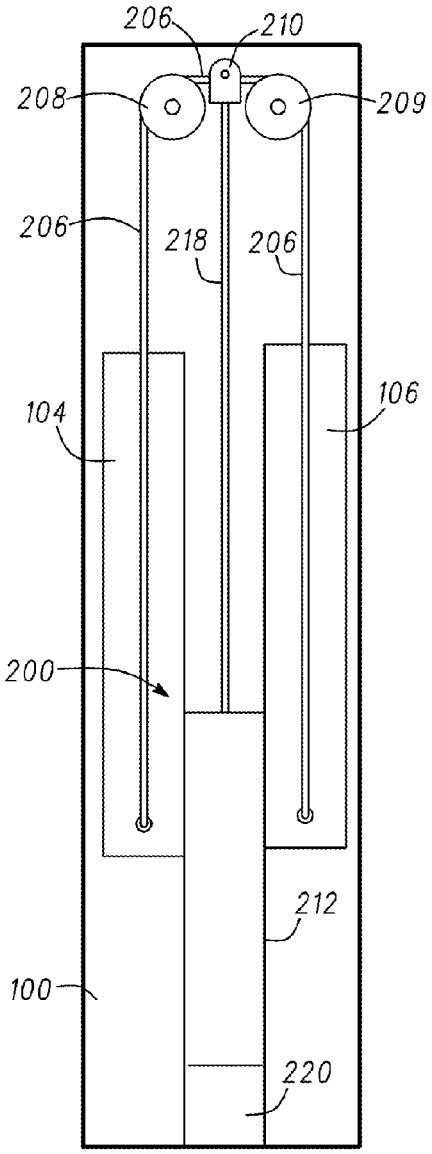
FIG. 3B is a schematic view showing the counterbalanced double hung window of FIG. 3A in an open position according to cooperation of the sashes.
Figure 3C:
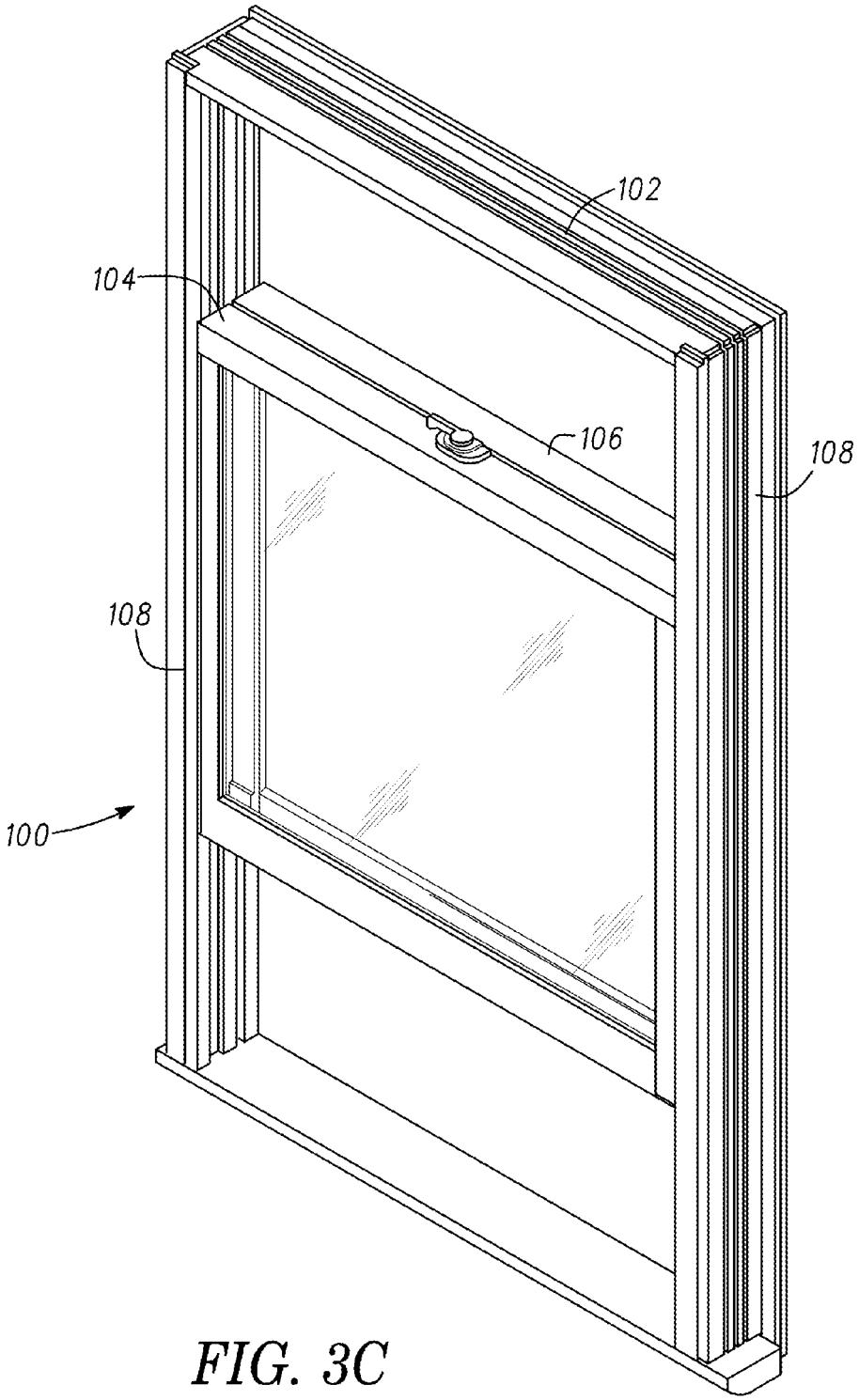
FIG. 3C is a perspective view of the counterbalanced double hung window of FIG. 3A in the counterbalanced open position.

Referring now to FIGS. 3A-C, the window 100 is shown in a counterbalance configuration with the first and second sashes 104, 106 in a counterbalanced, fully open orientation. For instance, as shown in FIG. 3C, the first and second sashes 104, 106 are in an aligned but counterbalanced configuration that provides openings at the top and the bottom of the frame 102.

As shown in FIGS. 3A and 3B, the counterbalance and assist mechanism 200 maintains the intermediate pulley 210 in the fully extended configuration. The sash coupling element 206 extends around the first and second guide pulleys 208, 209, such as without any retraction of the intermediate pulley 210 therebetween. Accordingly, raising the first sash 104 correspondingly lowers the second sash 106. As shown in the example of FIG. 3B, the counterbalance and assist mechanism 200, including the tension provided by the block and tackle 212 through the spring 220, provides insufficient tension to draw the intermediate pulley 210 toward the spring 220, for instance toward the sill of the frame 102. Instead, the tension provided through the sash coupling element 206, for instance by the first and second sashes 104, 106 as well as any incidental force applied by the user to raise or lower one or both of the sashes 104, 106 does not withdraw the intermediate pulley 210. Thus, the sashes 104, 106 as shown in FIGS. 3A, 3B and 3C, continue to operate in the counterbalance configuration because the intermediate pulley 210 remains in a substantially static position.

In contrast to the views shown FIGS. 3A, 3B, and 3C, FIGS. 4A and 4B show the window 100 with both of the sashes 104, 106 in raised positions, such as when the first and second sashes 104, 106 are movable independently relative to each other. The perspective view of FIG. 4C shows a maximized egress opening 400 available when the first and second sashes 104, 106 are moved into a fully open configuration, such as in the independent operating mode of the counterbalance and assist mechanism 200.

Figure 4A:
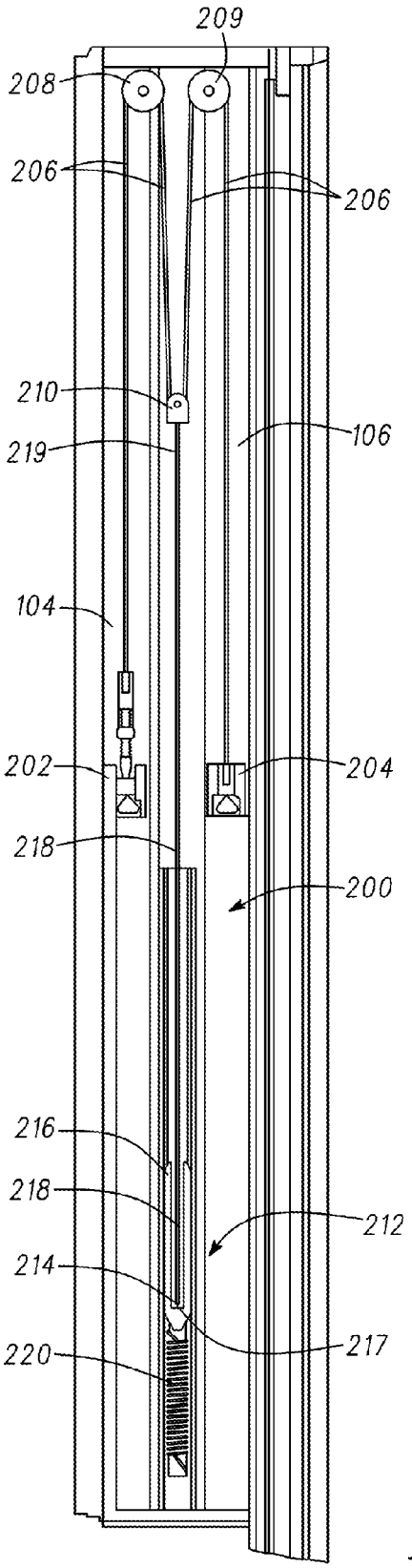
FIG. 4A is an exposed a cross sectional view of the counterbalanced double hung window of FIG. 2 in a fully open position.
Figure 4B:
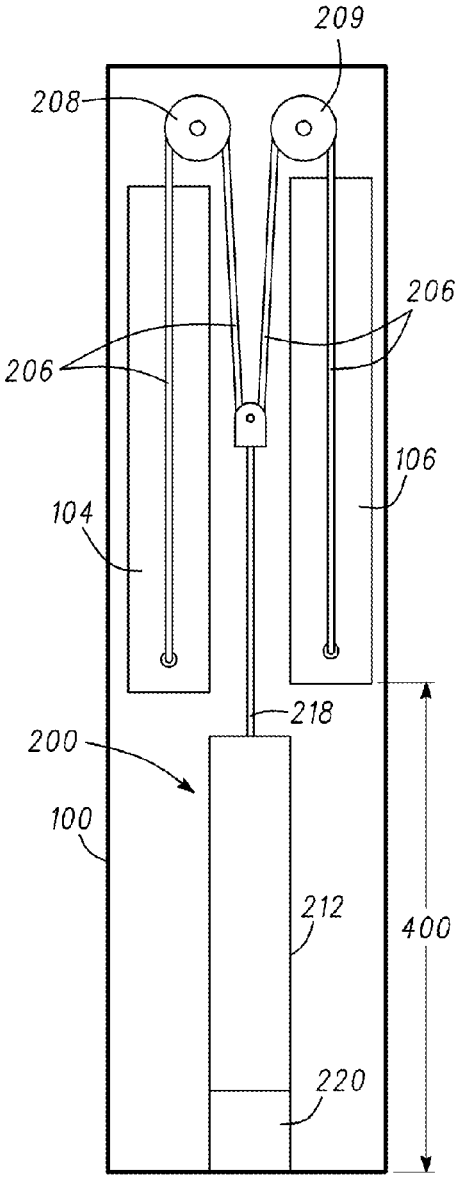
FIG. 4B is a schematic view of the counterbalanced double hung window of FIG. 4A in a fully open position.
Figure 4C:
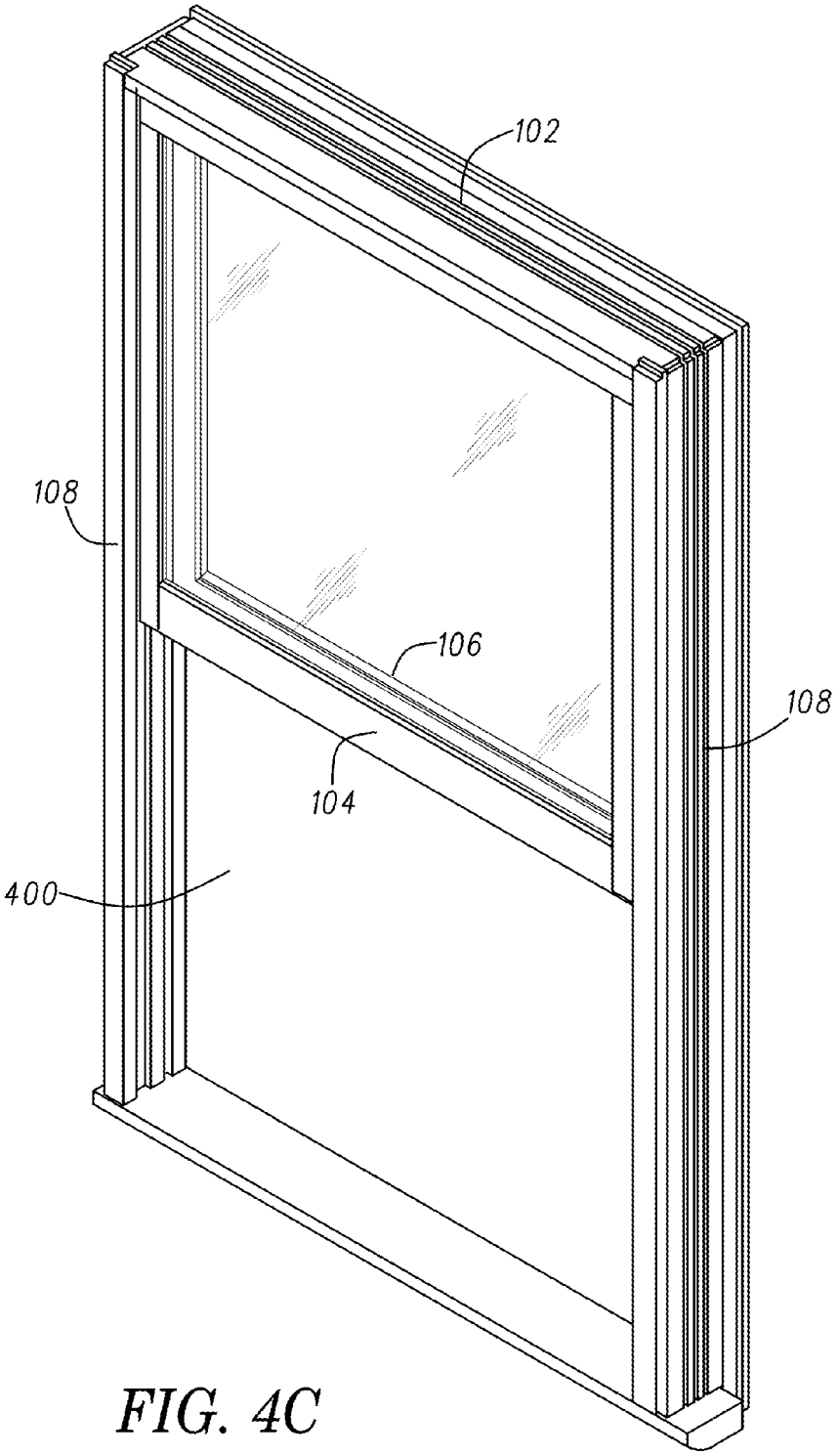
FIG. 4C is a perspective view of the counterbalanced double hung window of FIG. 4A in the fully open position.

Referring now to FIGS. 4A and 4B, the counterbalance and assist mechanism 200 is shown in an independent operating mode with the intermediate pulley 210 withdrawn (e.g., relative to the positions of the intermediate pulley 210 shown in the examples of FIGS. 2A, 2B, and 3A-3C). For instance, as shown in FIG. 4A, the intermediate pulley 210 is withdrawn toward the spring 220 as the first sash 104 is raised relative to the second sash 106.

In an example, the second sash 106 is held static as the first sash 104 is raised relative to the second sash 106, for instance with a clip, mechanical interfitting feature, pin, or the like, such as provided with the window 100, or is held static by the user.

In the example of FIGS. 4A and 4B, raising the first sash 104 correspondingly operates the spring 220 and the block and tackle 212.

For instance, the spring 220 transmits a tension force to the intermediate pulley 210 attenuated by the mechanical advantage of the block and tackle 212. As described above in the example of FIG. 2A, a second tackle element end 219 is coupled with the intermediate guide pulley 210, and a first tackle element end 217 is coupled with the first block 214.

Referring again the FIG. 4A, the mechanical advantage provided by the block and tackle 212 cooperates with the spring 220 and assists in raising the first sash 104.

Further, the counterbalance and assist mechanism 200, including the block and tackle 212 and the spring 220, provides tension in the open configuration to both of the first and second sashes 104, 106 to retain the sashes in the upper elevated position, and thereby maintain the maximized egress opening 400 (see, e.g., FIGS. 4B and 4C). In an example, as the first sash 104 is raised relative to the second sash 106 (e.g., in a first independent operating mode of the window 100), the counterbalance and assist mechanism 200 provides a tension to the intermediate pulley 210 to assist with raising the first sash 104.

For instance, the sash coupling element 206 is correspondingly tensioned upon withdrawal of the intermediate pulley 210 through operation of the spring 220 and the block and tackle 212. The tension on the sash coupling element 206 correspondingly assists in raising the first sash 104 while at the same time maintaining the second sash 106 in a previously raised orientation.

Even upon release by a user, the spring 220 and the block and tackle 212 can be configured (e.g., sized and shaped) to maintain the first and second sashes 104, 106 in the upper position after the first and second sashes 104, 106 are raised to the open position shown in FIGS. 4B and 4C. Stated another way, the counterbalance and assist mechanism 200 maintains at least some tension on the sashes 104, 106 throughout their movement and in the configuration of the maximized egress opening 400, shown in FIGS. 4B and 4C, and accordingly maintains the sashes 104, 106 in the fully opened position.

In an example, the counterbalance and assist mechanism 200 transitions from the independent operating mode (e.g., shown in FIGS. 4A, 4B, and 4C), to the counterbalance mode.

In an example, the first sash 104 is lowered relative to the second sash 106 thereby moving the intermediate pulley 210 against a tension provided by the spring 220 through the block and tackle 212. Accordingly, the intermediate pulley 210 is moved back into a position nearing that shown in FIGS. 2A and 3A, and the counterbalance and assist mechanism 200 transitions back to the counterbalance mode. Accordingly, lifting and sliding of either of the sashes 104, 106 results in counterbalanced movement of each of the sashes relative to one another, as described above.

In an example that includes a double hung window (e.g., the window 100 of FIG. 1), the counterbalance and assist mechanism 200 is modeled with the following relationship analyzed at the intermediate pulley 210:

$$W_s = \left(\frac{1}{MA} T_s \pm F_{BT}\right) \tag{1}$$

where $W_S$ is the weight of the sashes, MA is the block and tackle mechanical advantage (e.g., a mechanical advantage of 5 will decrease the spring tension by an order of 5), $T_S$ is the spring tension, and $F_{BT}$ is the block and tackle mechanism friction (directional).

The mechanism relationship provided by Equation (1) is a prophetic example. Other relationships for a mechanism are possible and within the breadth of this disclosure. For instance, instead of the block and tackle 212 and spring 220 used with the counterbalance and assist mechanism 200, other assemblies may be used with the counterbalance and assist mechanism 200 including, but not limited to, a spiral-type balance, a constant force spring balance, a counter weight, an extension spring by itself, a compression spring, an electric motor drive, or the like, or other methods for storing energy and providing assistance and counterbalancing while also allowing independent operation of the sashes as described herein.

With the example relationship provided in Equation (1), the counterbalance and assist mechanism 200 is modeled with the following inequalities during a counterbalancing operation mode:

$$W_s > \left(\frac{1}{MA} T_s - F_{BT}\right) \tag{2}$$

$$W_s < \left(\frac{1}{MA} T_s + F_{BT}\right) \tag{3}$$

Inequality (2) corresponds to raising of a sash, and Inequality (3) corresponds to lowering of a sash. These example inequalities confirm that the counterbalance and assist mechanism 200 will retain the intermediate pulley 210 in a static location while each of the sashes 104, 106 is free to move (and neither of the sashes is at the end of its travel within the frame 102). The friction of the block and tackle $F_{BT}$ (or other spring bias element) can be chosen based on the mechanical advantage, spring constant of the spring 220, and the weights of the sashes, such as to ensure that each of these inequalities is satisfied with opening or closing movement of the sashes with each of the sashes free to move. Optionally, one or more of the above variables is chosen according to preferred lifting assistance in the independent operating mode (e.g., one or more of the spring constant, mechanical advantage, and $F_{BT}$).

Similarly, a system with the counterbalance and assist mechanism 200 can be modeled in independent operating modes. The counterbalance and assist mechanism 200 assumes the following relationship when one of the sashes 104, 106 is raised and the other of the sashes 106, 104, is held static or is also raised (e.g., a first independent operation mode):

$$W_s - F_{user} \leq \left(\frac{1}{MA}T_s - F_{BT}\right) \tag{4}$$

Inequality (4) represents retraction of the intermediate pulley 210 with raising of at least one sash, where $F_{user}$ is the force provided by a user to raise a sash.

When one of the sashes 104, 106 is held static or is at the end of its travel in a direction opposed to the direction of travel of the moving sash, the counterbalance and assist mechanism 200 may not counterbalance the moving sash. Instead, a force provided by a user (no longer counterbalanced and accordingly a factor) in combination with the assistance provided by the mechanism 200 moves the sash and accordingly moves the intermediate pulley 210, for instance because the opposed sash is held static or is being moved in the same direction as the first moved sash. Accordingly, the force provided by the user cooperates with the tension provided by the counterbalance and assist mechanism 200 to retract the intermediate pulley 210 when one or more of the sashes is raised.

When lowering one or more of the sashes 104, 106 the system with the counterbalance and assist mechanism 200 is modeled in a second independent operating mode with the friction of the block and tackle 212 reversed as one or more of the sashes 104, 106 are lowered. The counterbalance and assist mechanism 200 assumes the following relationship with one of the sashes 104, 106 in a lowered position, and the other of the sashes 104, 106 held static or also lowered (e.g., a second independent operation mode):

$$W_s + F_{user} \geq \left(\frac{1}{MA}T_s + F_{BT}\right) \tag{5}$$

Inequality (5) represents extension of the intermediate pulley 210 with lowering of at least one of the sashes 104, 106 where $F_{user}$ is the force provided by user to lower a sash. With one of the sashes 104, 106 held static or at the end of its travel in a direction opposed to the direction of travel of the moving sash, the counterbalance and assist mechanism 200 does not counterbalance the moving sash. Instead, the force provided by the user (no longer counterbalanced and accordingly a factor) in combination with the assistance provided by the counterbalance and assist mechanism 200 moves the sash and accordingly moves the intermediate pulley 210 (e.g., since the opposed sash is held static or is moved in the same direction as the first moved sash). Accordingly, the force provided by the user overcomes the tension provided by the counterbalance and assist mechanism 200 to extend the intermediate pulley 210 during lowering of one or more of the sashes 104, 106.

As shown for each of the counterbalancing and independent operating modes, the sign of the block and tackle friction ($F_{BT}$) depends on lifting, lowering, or retention of one or more of the sashes in a static position. The block and tackle friction provides resistance in the counterbalance mode to resist extension and retraction of the intermediate pulley 210 during lowering and raising of a sash, respectively. That is to say, the block and tackle friction attenuates the tension provided by the counterbalance and assist mechanism 200 as a sash 104, 106 is raised in the counterbalance mode to prevent retraction of the intermediate pulley 210 and accordingly maintain the counterbalance. Similarly, the block and tackle friction enhances the tension provided by the counterbalance and assist mechanism 200 as a sash 104, 106 is lowered in the counterbalance mode to prevent extension of the intermediate pulley 210 and maintain the counterbalance.

Figure 5A:
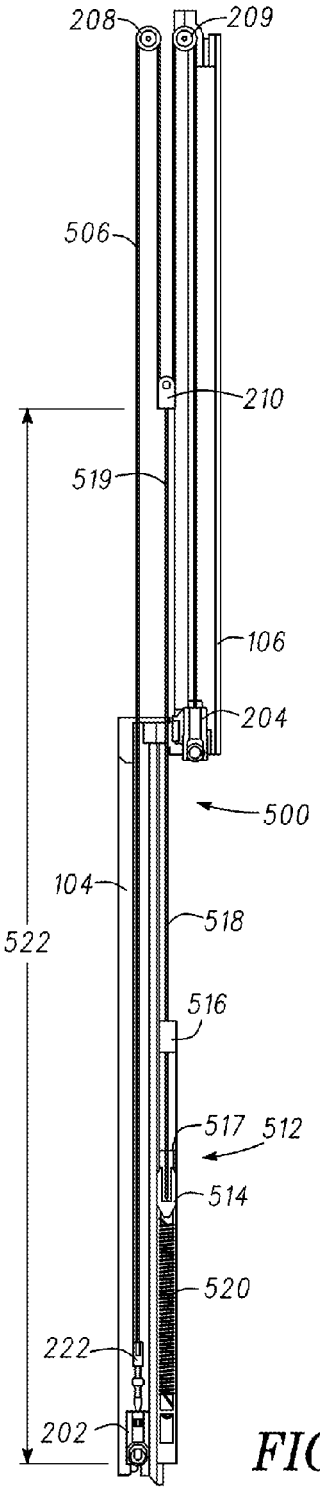
FIG. 5A is an exposed a cross sectional view of another example of a counterbalanced double hung window with independently operable sashes in a closed position.
Figure 5B:
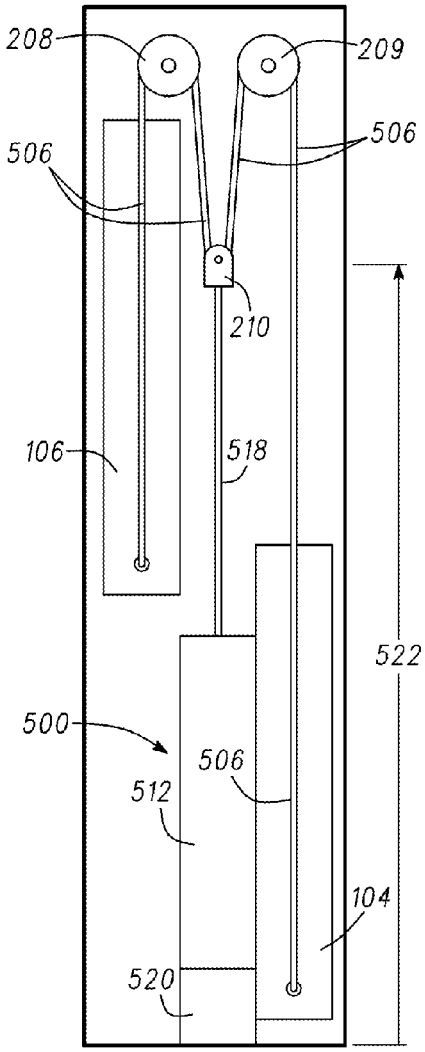
FIG. 5B is a schematic view of the counterbalanced double hung window of FIG. 5A in the 5 closed position.

FIGS. 5A and 5B show exposed and schematic views, respectively, of the window 100, including a second example of a counterbalance and assist mechanism 500. Many of the features of the previous exemplary window 100 are included in the examples of FIGS. 5A and 5B. For example, the window 100 shown in FIGS. 5A and 5B includes first and second sashes 104, 106 slidably positioned within a frame, such as the frame 102 shown in FIG. 1. Additionally, the sashes 104, 106 are coupled with a sash coupling element 506, for instance, at the anchors 202, 204, such as including tilt clutches configured to allow tilting of the sashes 104, 106. As shown in FIGS. 5A and 5B, the sash coupling element 506 is coupled around guide pulleys 208, 209, and an intermediate pulley 210. As previously described with regard to the examples shown in FIGS. 1A-4C, the intermediate pulley 210 is moveable in a vertical direction, for instance along the longitudinal axis of the window 102 according to operation of 5 the counterbalance and assist mechanism 500 in an independent operating mode wherein the first and second sashes 104, 106 are movable independently relative to one another.

In the example of FIGS. 5A and 5B, the sashes 104, 106 can move in a counterbalance mode, and can also move independently whether in a fully opened configuration (e.g., wherein the sashes 104, 106 are both raised relative to the frame 102) or in a fully lowered configuration (e.g., wherein both of the sashes 104, 106 are both lowered, for instance at the lower most position on the frame 102). In this example, the intermediate pulley 210 is coupled between the first and second sashes 104, 106 and is configured not only to withdraw when the sashes 104, 106 are raised independently relative to one another, but also to extend in the converse configuration where the sashes are lowered, for instance into a fully lowered configuration, thereby providing a fully open orifice (e.g., corresponding to the maximized egress opening 400). Stated another way, the intermediate pulley 210 can move vertically up and down relative to the position shown, for instance, in FIGS. 5A and 5B.

As shown in the example of FIG. 5A, the counterbalance and assist mechanism 500 includes a block and tackle 512 having first and second blocks 514, 516, as well as a flexible tackle element 518. As with the previously described examples, the flexible tackle element 518 includes a first tackle element end 517 coupled with the first block 514. At the opposed end of the flexible tackle element 512, the second tackle element end 519 is correspondingly coupled with the intermediate pulley 210. A spring 520 extends between a lower-most portion of the window 100 (e.g., coupled with the frame 102) and the first block 514.

Referring now to FIG. 5B, the window 100 is shown with the first and second sashes 104, 106 in the closed configuration with the intermediate pulley 210 positioned at an initial intermediate pulley position 522 relative to an end of the spring 520 (e.g., to the sill of the frame 102). As previously described, the intermediate pulley 210 is capable of translation upwardly or downwardly relative to the frame 102, for instance along a line coaxial with the flexible tackle element 518 extending from the block and tackle 512 to the intermediate pulley 210. In the independent operating modes of the window 100, the intermediate pulley 210 moves upwardly or downwardly depending on the relative movement of the sashes 104, 106. For example, as the sashes are lowered toward a fully opened position with the opening of the window near the top of the frame 102, the intermediate pulley 210 translates upwardly. Conversely, as the sashes are raised toward a fully opened position where the egress opening of the window is fully open, for instance at the bottom portion of the window, the intermediate pulley 210 is withdrawn, or translates downwardly, according to operation of the counterbalance and assist mechanism 500, including the block and tackle 512 and the tension provided by the spring 520.

Figure 6A:
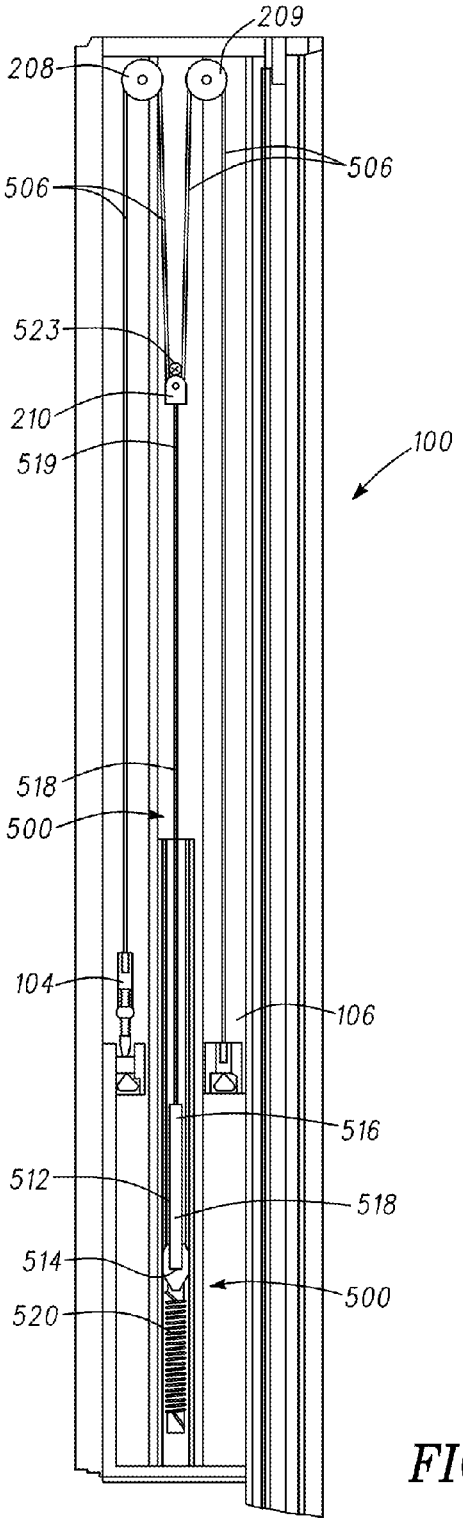
FIG. 6A is an exposed a cross sectional view of the counterbalanced double hung window of FIG. 5A in a counterbalanced open position.
Figure 6B:
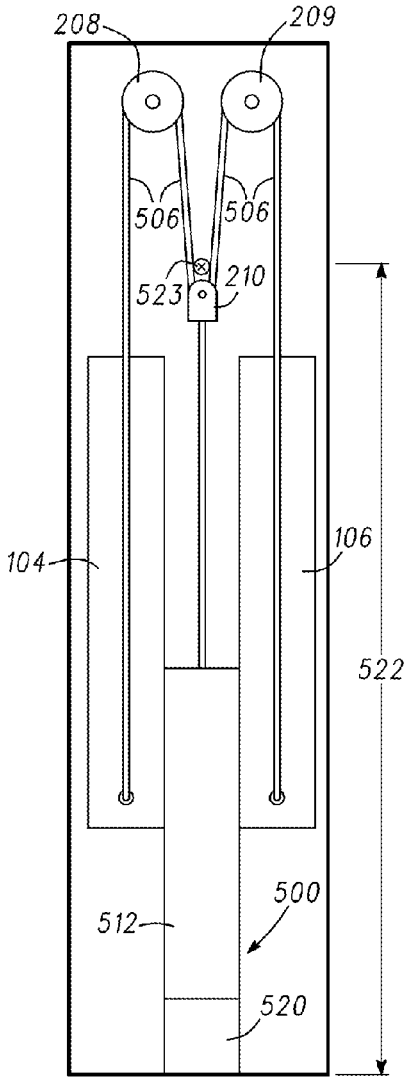
FIG. 6B is a schematic view of the counterbalanced double hung window of FIG. 6A in a counterbalanced open position.

FIGS. 6A and 6B show the window 100 in a counterbalance mode with the first and second sashes 104, 106 translated into an intermediate position wherein openings are formed above and below the first and second sashes 104, 106. In the configuration of FIG. 6A, the intermediate pulley 210 is again positioned at the initial intermediate pulley position 522 relative to the bottom of the frame 102 or at one end of the spring 520. In this configuration, as the first sash 104 is raised relative to the second sash 106, the second sash 106 descends, thereby confirming that the first and second sashes 104, 106 are counterbalanced with the counterbalance and assist mechanism 500. That is to say as the first sash 104 is raised, the second sash 106 provides counterbalancing assistance to a force provided by the user to raise the first sash 104. In a similar manner, a counterbalance force is provided by the first sash 104 to the second sash 106 as the second sash is moved toward a lowered configuration, such as shown in FIG. 6A or 6B.

Referring now to FIG. 6B, the window 100 is shown in schematic view with the first and second sashes 104, 106. As shown, the intermediate pulley 210 is positioned at the initial intermediate pulley position 522, as previously shown in FIGS. 5A, 5B and 6A. In this configuration, the counterbalance and assist mechanism 500, for instance the spring 520 and the block and tackle 512, are configured by way of the spring constant and the friction of the system of the block and tackle 512, or by another characteristic of the counterbalance and assist mechanism 500, to provide a moderated tension force to the intermediate pulley 210. The counterbalance and assist mechanism 500 maintains the intermediate pulley 210 in a static position, and thereby allows the first and second sashes 104, 106 to continue to counterbalance one another. That is to say the intermediate pulley 210 is held in a passive configuration without upward or downward translation, thereby allowing the first and second sashes 104, 106 to counterbalance one another throughout movement while the first and second sashes 104, 106 are free to move (e.g., not held in place, for instance by a hand of the user).

Figure 6C:
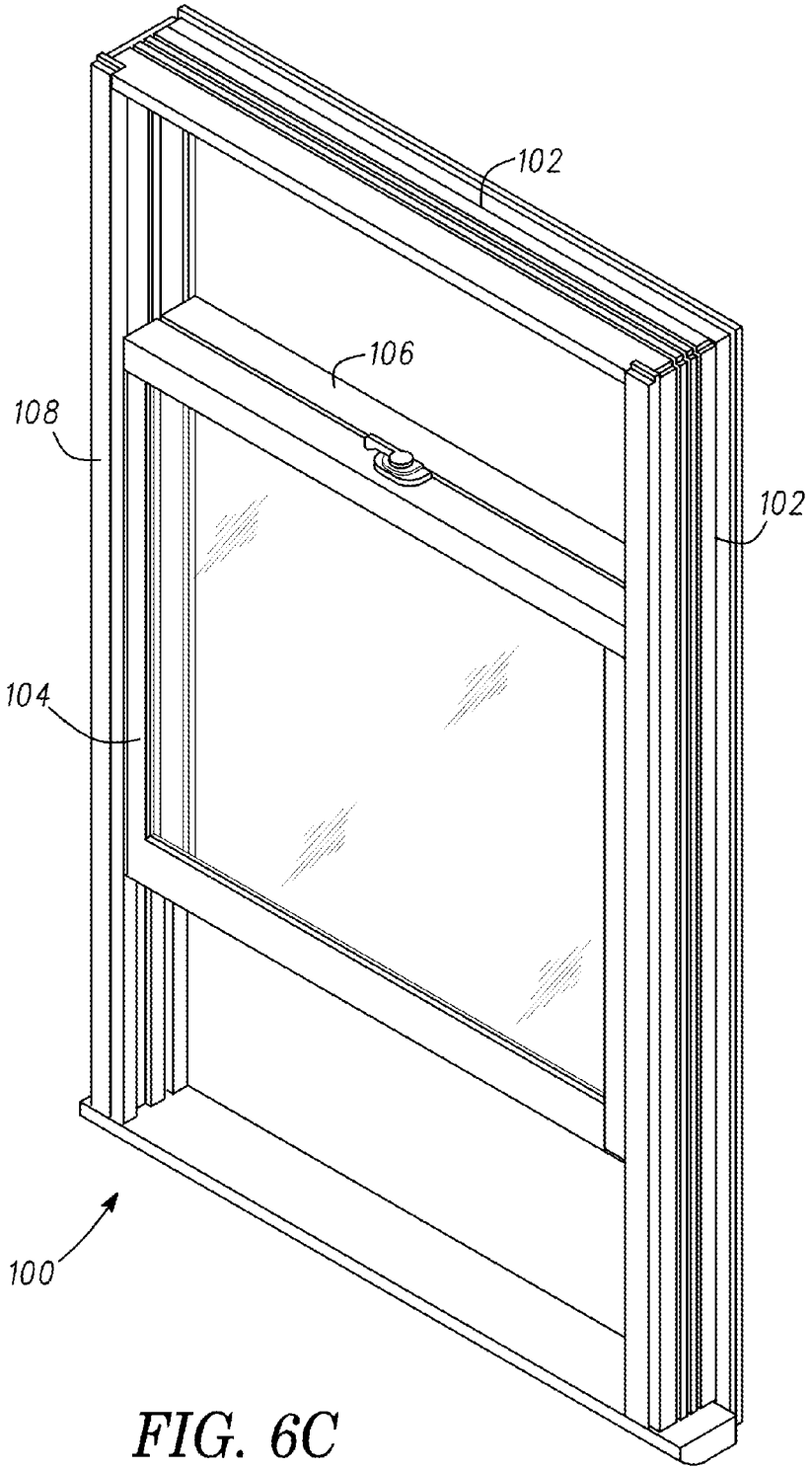
FIG. 6C is a perspective view of the counterbalanced double hung window of FIG. 6A in the counterbalanced open position.

FIG. 6C shows the window 100 in a perspective view. As shown, the first and second sashes 104, 106 are again in the counterbalance configuration previously shown in FIGS. 6A and 6B. That is, the sashes 104, 106 are positioned intermediately according to the operation of one of the sashes 104, 106, for instance, by raising or lowering one or more of the first sash 104 or the second sash 106.

Optionally, one or more retainers 523 are provided in line with the intermediate pulley 210. In an example, the one or more retainers include, but are not limited to, pins, fasteners, stops, bars, and the like. As shown in FIGS. 6A and 6B, the retainer 523 is positioned above the intermediate pulley 210 in the counterbalance mode. The retainer 523 interrupts movement (e.g., prevents movement) of the intermediate pulley 210 upwardly from the position shown in FIGS. 6A and 6B, and correspondingly prevents movement of the intermediate pulley 210 during a second independent operating mode wherein the first and second sashes 104, 106 are lowered (see, e.g., FIGS. 8A-8C).

As shown in FIGS. 6A and 6B, the optional retainer 523 allows for independent movement when the sashes 104, 106 are raised and the pulley 210 is accordingly retracted. Accordingly, a user may move the retainer 523 into position above the intermediate pulley 210 and thereby substantially preclude independent operation of the sashes 104, 106. Accordingly, the window 100 with the counterbalance and assist mechanism 500 constrained by the retainer 523 operates in a similar fashion to the window with the counterbalance and assist mechanism 200.

In still another example, the retainer 523 is instead positioned below the intermediate pulley 210 in the counterbalance mode, and thereby allows for counterbalancing and independent operation of the sashes 104, 106. However, the independent operation of the sashes 104, 106 is, in an example, constrained to lowering the windows toward the configuration shown in FIGS. 8A-8C or some intermediate position. Optionally, the retainer 523 extends through the intermediate pulley 210 and thereby fixes the pulley at a static location to ensure only counterbalance operation of the sashes 104, 106 is possible. This provides some assurance that the opening of the sashes is limited to the smaller configuration shown in FIG. 6C, as independent operation of the sashes 104, 106 is prohibited.

Figure 7A:
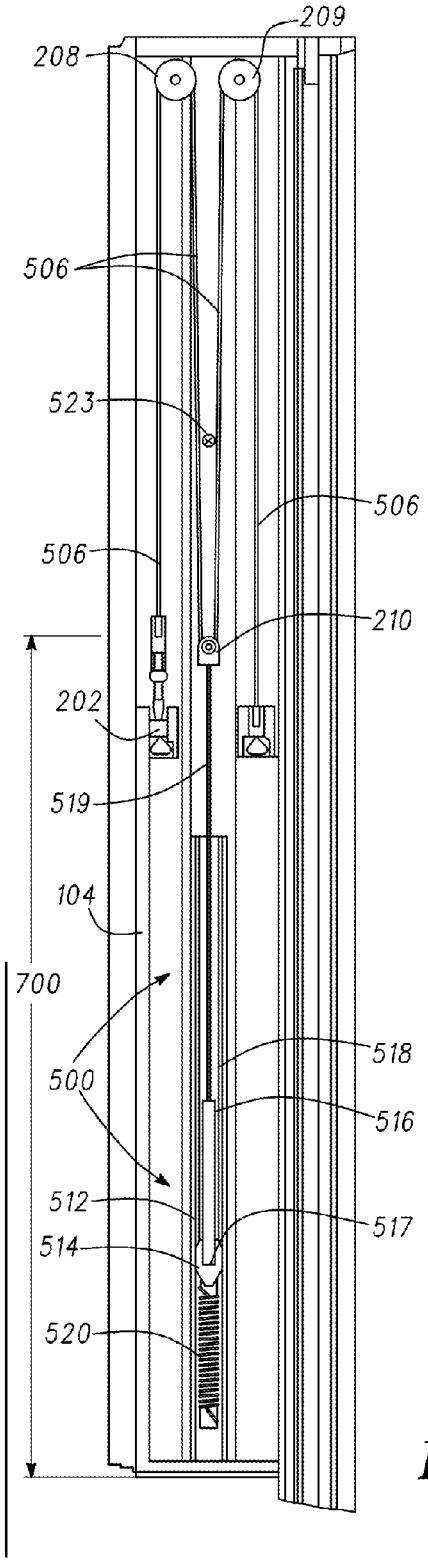
FIG. 7A is an exposed a cross sectional view of the counterbalanced double hung window of FIG. 5A in a first fully open position with the window opening at the top of the window frame.
Figure 7B:
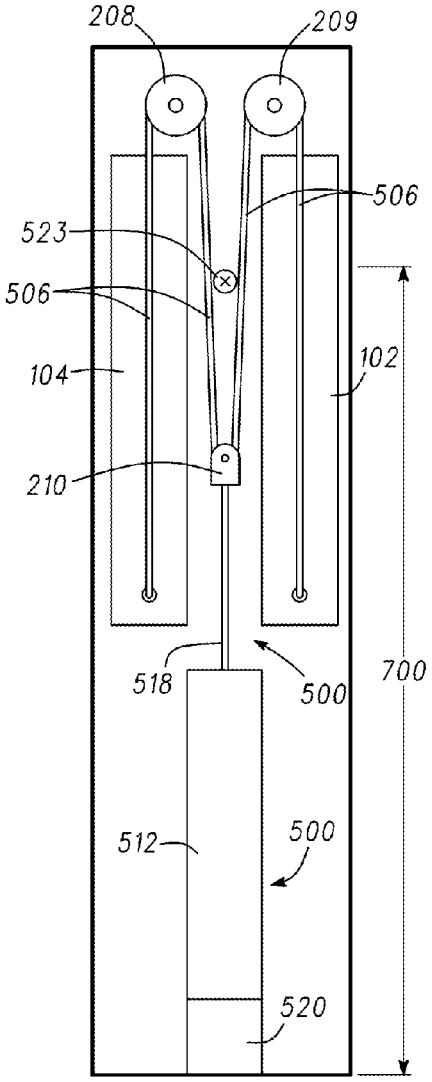
FIG. 7B is a schematic view of the counterbalanced double hung window of FIG. 7A in a first fully open position with the window opening at the top of the window frame.
Figure 7C:
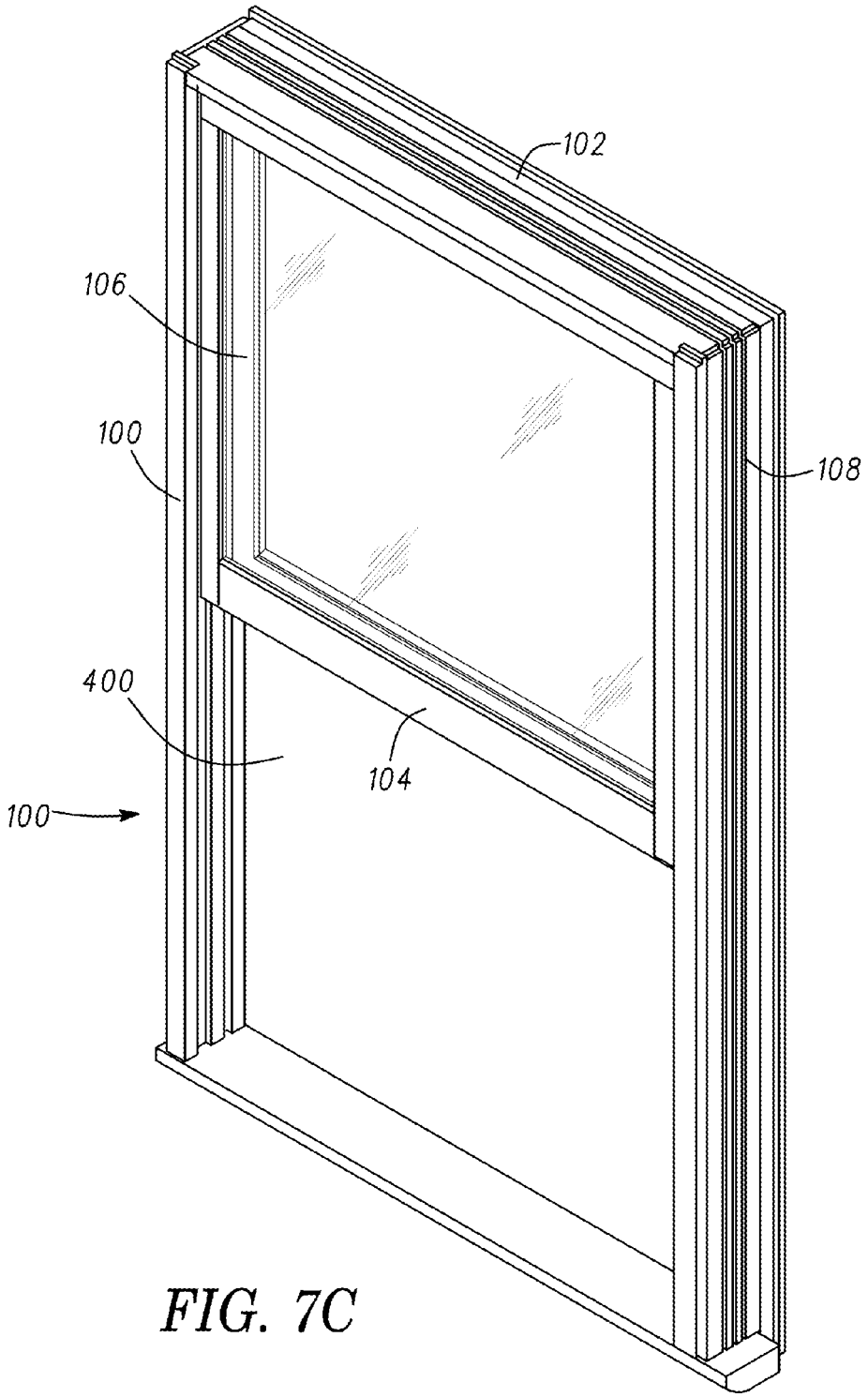
FIG. 7C is a perspective view of the counterbalanced double hung window of FIG. 7A in the first fully open position.

Referring now to FIGS. 7A-7C, another view is shown of the window 100 including the counterbalance and assist mechanism 500. As shown in FIG. 7C, both of the sashes 104, 106 are in a lifted configuration thereby providing a fully opened position, for example, corresponding to the maximized egress opening 400 described above. The counterbalance and assist mechanism 500 is shown in an independent operating mode, with the first and second sashes 104, 106 operated independently relative to one another, to position the sashes in the upward orientation shown in FIG. 7C. In FIG. 7A, the sashes 104, 106 including their respective anchors 202, 204 are shown in a raised configuration with the intermediate pulley 210 in a translated position (e.g., translated from the orientation shown in FIGS. 6A and 6B).

As shown in FIG. 7A, the intermediate pulley 210 is at a first fully open pulley position 700 relative to the initial intermediate pulley position 522 (see, e.g., FIG. 5A). The first fully open pulley position 700 is relatively shorter, that is, the intermediate pulley 210 is positioned more closely to the spring 520, including, for instance, an end of the spring 520 coupled with the sill and frame 102. As shown in FIGS. 7A and 7B, one of the sashes, such as the second sash 106, is held in the static position, while the first sash 104 is raised. As the first sash 104 is raised, the intermediate pulley 210, acting under tension provided by the spring 520 and through the mechanical advantage provided by the block and tackle 512, is withdrawn. That is, the intermediate pulley 210 is translated downward relative to the initial intermediate pulley position 522 shown in FIGS. 5A and 5B. By withdrawing the intermediate pulley 210, slack in the sash coupling element 506 is removed as the intermediate pulley 210 maintains the sash coupling element 506 in tension between each of the first and second sashes 104, 106.

Additionally, the counterbalance in the assist mechanism 500 provides lifting assistance to the first sash 104 as the first sash is elevated relative to the originally closed position, shown for instance in FIGS. 5A and 5B. That is to say, as shown in FIGS. 7A and 7B, the window 100 including the first and second sashes 104, 106 has transitioned from the counterbalance mode of operation to an independent mode of operation where the first and second sashes 104, 106 are moveable relative to one another without counterbalancing. Instead, the counterbalance and assist mechanism 500 applies a tension to the intermediate pulley 210 that is accordingly transmitted to one or both of the sashes 104, 106 to assist with lifting the sashes relative to the remainder of the window 100.

FIG. 7B shows a schematic view of the window 100. In the example of FIG. 7B, the first and second sashes 104, 106 are elevated into an open position to provide the maximized egress opening 400 (see FIG. 7C). As shown in FIG. 7B, the intermediate pulley 210 is again withdrawn relative to the position originally shown in FIGS. 6A and 6B. For instance, the intermediate pulley is at the first fully open pulley position 700, and can be drawn into that position by operation of the counterbalance and assist mechanism 500 including, for instance, the spring 520 and the block and tackle 512. When at least one of the sashes is held static in a raised orientation and the other sash is raised, intermediate pulley 210 withdraws to provide lifting assistance to raising sash, while at the same time retaining both of the sashes in the raised, or open, position. That is, the counterbalance and assist mechanism 500 provides lifting assistance to either of the sashes 104, 106, and also retains the sashes 104, 106 in any desired position within the frame 102. One example of such a position is shown in FIGS. 7B and 7C. In an example, the counterbalance and assist mechanism 500 is dimensioned and configured by way of the spring constant of the spring 520, the mechanism friction, and the mechanical advantage provided by the block and tackle 512, such as to accordingly hold the sashes 104, 106 in a desired position without allowing the sashes to descend, for instance due to a lack of tension in the counterbalance and assist mechanism 500, or without drawing the sashes 104, 106 upwardly for instance by the application of too much tension.

Figure 8A:
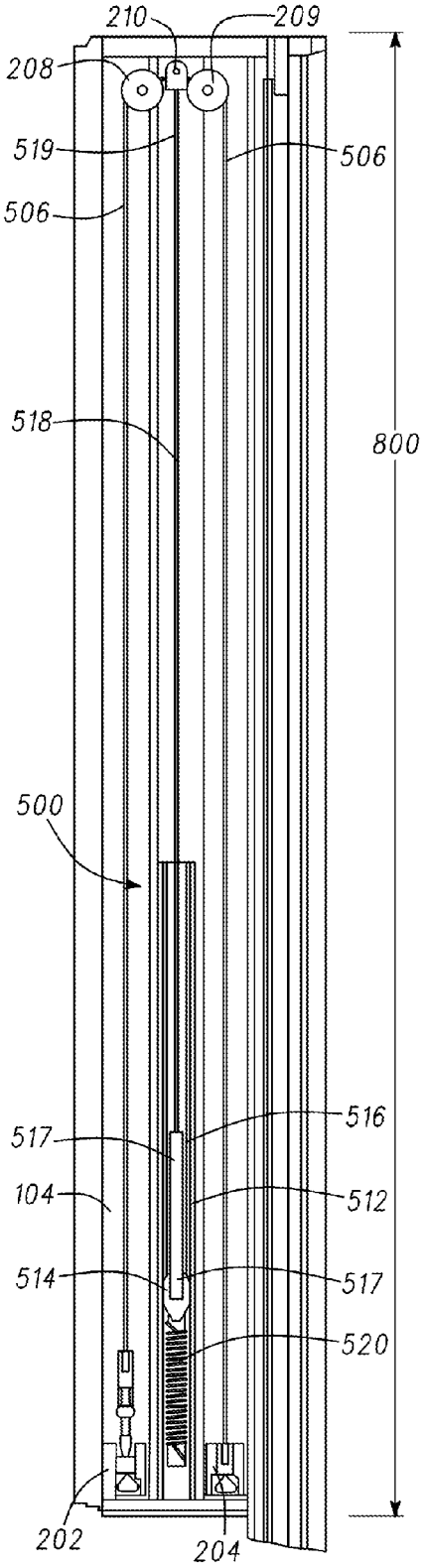
FIG. 8A is an exposed a cross sectional view of the counterbalanced double hung window of FIG. 5A in a second fully open position with the window opening at the bottom of the window frame.
Figure 8B:
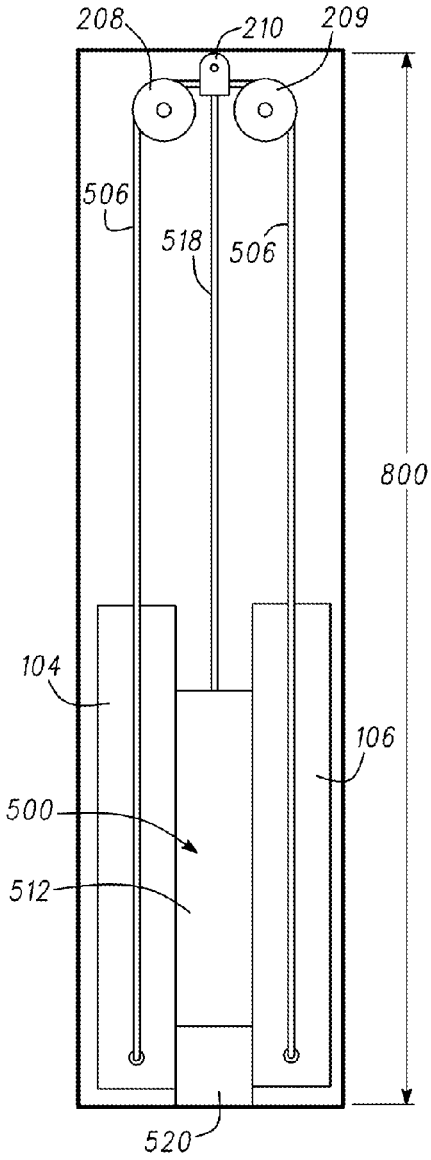
FIG. 8B is a schematic view of the counterbalanced double hung window of FIG. 8A in a second fully open position with the window opening at the bottom of the window frame.
Figure 8C:
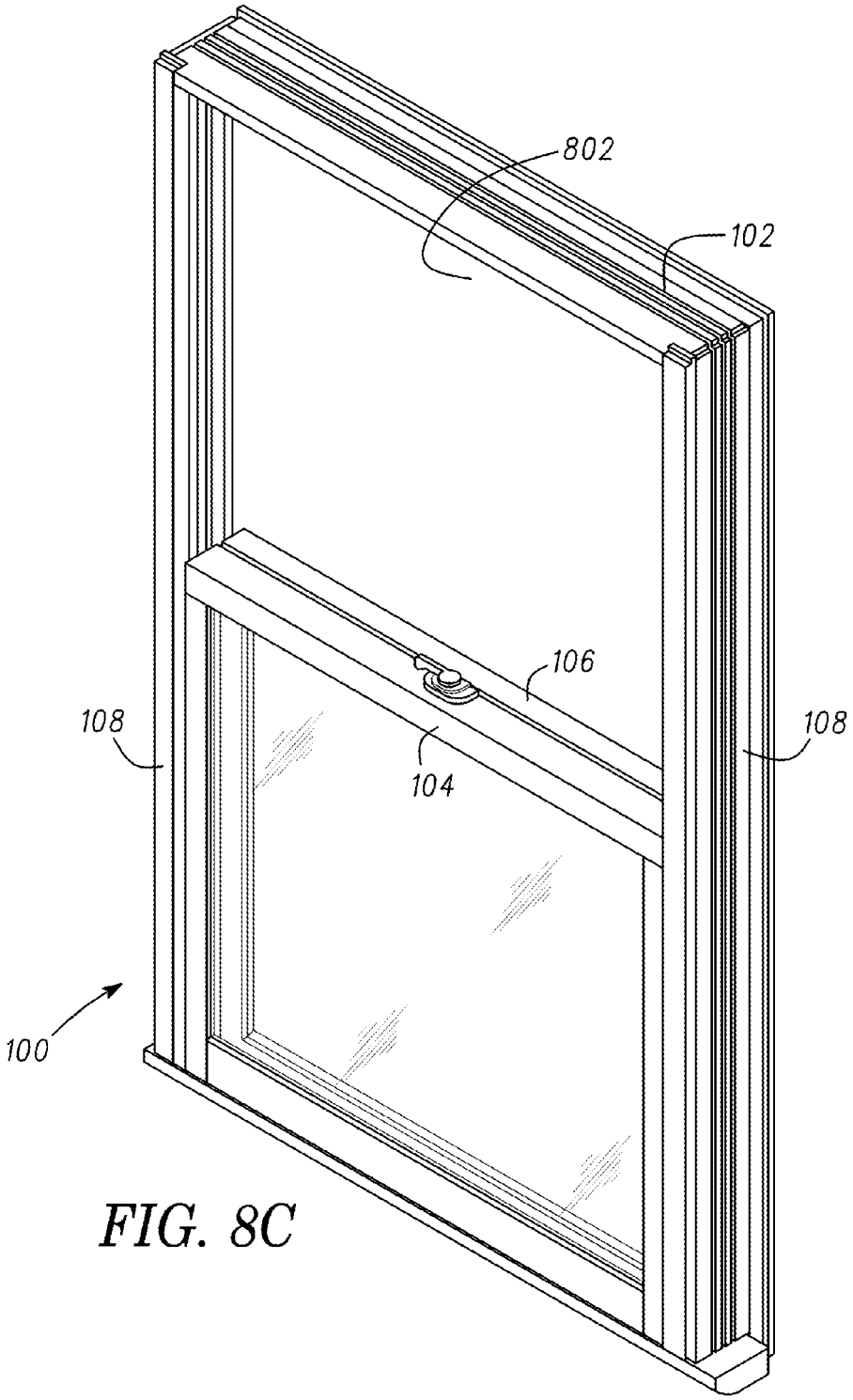
FIG. 8C is a perspective view of the counterbalanced double hung window of FIG. 8A in the second fully open position.

FIGS. 8A, 8B, and 8C, show the window 100 in an orientation with the first and second sashes 104, 106 in another fully opened position. In this example, both the first and second sashes 104, 106 are fully lowered. As shown in FIG. 8A, the first and second sashes 104, 106, including the anchors 202, 204 are shown fully descended relative to the remainder of the frame 102. In this example the intermediate pulley 210 is shown in a second fully open pulley position 800. The second fully open pulley position 800 corresponds to a position of the intermediate pulley 210 translated relative to the above-described positions. For instance, the spring 520 is fully extended relative to the travel of the intermediate pulley 210 because the first and second sashes 104, 106 are in the fully lowered position. To arrive at this configuration, for instance, the first sash 104 can be held in a static position while the second sash 106 is forcibly moved by a user into the lowered configuration. As the second sash 106 is lowered, it operates independently relative to the first sash 104. The counterbalance and assist mechanism 500 provides an opposing tension to the movement of the second sash 106, however the tension is attenuated by the mechanical advantage provided by the block and tackle 512, and can be overcome by the user's force. Accordingly, the user experiences little to no resistance to the movement of the second sash 106 into the lowered position by the counterbalance and assist mechanism 500. In contrast, as one or both of the sashes 104, 106 are raised, for instance toward the configuration shown in FIGS. 7A, 7B, and 7C, the counterbalance and assist mechanism 500 provides a noticeable and helpful assistance to the user's force to raise one or both of the sashes 104, 106. As will be described herein, the mechanical advantage and the friction of the block and tackle 512 attenuates the resistance to lowering one or both of the sashes 104, 106, yet provides assistance in the opposed direction, for instance while one or both of the sashes 104, 106 are raised.

In an example, the intermediate pulley 210 can move from the initial intermediate pulley position 522 (see FIG. 5A) to the second fully open pulley position 800 shown in FIG. 8A. That is, the intermediate pulley 210 as shown in FIG. 5A is initially spaced from the top of the window 100, and the intermediate pulley 210 can move upward with lowering of one or both of the sashes 104, 106, such as toward the configuration shown in FIGS. 8A-8C.

FIG. 8B shows a schematic view of the window 100 shown in FIG. 8A. In this example, both of the sashes 104, 106 are lowered to provide a fully opened position 802. The fully opened position 802 can correspond to a venting position, such as shown in the example of FIG. 8C. Referring again to FIG. 8B, the intermediate pulley 210 is fully translated into the raised position corresponding to the second fully opened pulley position 800 (e.g., a distance measured from the bottom of the frame or a bottom end portion of the spring 520 relative to the intermediate pulley 210). As shown, the sashes 104, 106 are coupled by the sash coupling element 506, and the counterbalance and assist mechanism 500 including the block and tackle 512 and the spring 520 continue to apply a tension to the sash coupling element 506 for instance to remove slack from the element during the operational lifetime of the window 100. The counterbalance and assist mechanism 500 provides attenuated tension for instance through operation of the block and tackle 512 as well as selection of an appropriate spring constant in the spring 520 to thereby allow for the maintenance of the intermediate pulley at the position shown in FIG. 8B while allowing the first and second sashes 104, 106 to correspondingly remain in the lowered positions. That is, the intermediate pulley 210 does not experience a significant enough tension by way of the counterbalance and assist mechanism 500 to draw the pulley 210 downwardly and thereby elevate the first or second sashes 104, 106 from the position shown in FIG. 8B. Instead, as one or both of the sashes 104, 106 is raised, the counterbalance and assist mechanism 500 provides assistance in raising the sashes 104, 106 and removing slack from the sash coupling element 506, but not enough force by itself to raise or move the sashes 104, 106.

Referring now to FIG. 8C the window 100 is shown in a second fully opened position 802 where the sashes 104, 106 as previously shown in FIGS. 8A and 8B is in a fully lowered position. In this configuration for instance with the second fully opened position 802 the window 100 is configured by way of the independent operation of the sashes 104, 106 to thereby provide a venting opening for the window 100.

The counterbalance and assist mechanism 500 used in an example that includes the double hung window 100 shown in FIG. 1, can be similarly modeled using the relationship provided above in Equation (1), such as at the intermediate pulley 210. Other relationships for the counterbalance and assist mechanism 500 are possible and within the breadth of this disclosure. For instance, instead of the block and tackle 512 and spring 520 used with the counterbalance and assist mechanism 500, another assembly may be used with the mechanism 500 including, but not limited to, a spiral-type balance, a constant force spring balance, counter weight, an extension spring by itself, a compression spring, an electric motor drive or the like, or other methods for storing energy and providing assistance and counterbalancing while also allowing independent operation of the sashes as described herein.

With the example relationship provided in Equation (1), the counterbalance and assist mechanism 500 can be modeled with Inequalities (2) and (3), such as during a counterbalancing operation mode. These example inequalities confirm that the counterbalance and assist mechanism 500 will retain the intermediate pulley 210 in a static location while each of the sashes 104, 106 is free to move (and neither of the sashes is at the end of its travel within the frame 102). The friction of the block and tackle $F_{BT}$ (or other spring bias element) can be chosen based on the mechanical advantage, spring constant of the spring 520, and the weights of the sashes, such as to ensure that each of these inequalities is satisfied with opening or closing movement of the sashes with each of the sashes free to move. Optionally, one or more of the above variables is chosen according to preferred lifting assistance in the independent operating mode (e.g., one or more of the spring constant, mechanical advantage, and $F_{BT}$).

Similarly, the system provided above with the counterbalance and assist mechanism 500 can be modeled in independent operating modes. The counterbalance and assist mechanism 500 assumes the following relationship provided by Inequality (4) when one of the sashes 104, 106 is raised and the other of the sashes 106, 104 is held static or is also raised.

When one of the sashes 104, 106 is held static or is at the end of its travel in a direction opposed to the direction of travel of the moving sash, the counterbalance and assist mechanism 500 does not counterbalance the moving sash. Instead, a force provided by a user combines with assistance provided by the mechanism 500 to move the sash and accordingly move the intermediate pulley 210, for instance because the opposed sash is held static or is being moved in the same direction as the first moved sash. Accordingly, the force provided by the user cooperates with the tension provided by the counterbalance and assist mechanism 500 to retract the intermediate pulley 210 when one or more of the sashes is raised.

When lowering one or more of the sashes 104, 106 the system with the counterbalance and assist mechanism 500 can be modeled in a second independent operating mode with the friction of the block and tackle 212 reversed as one or more of the sashes 104, 106 are lowered. The counterbalance and assist mechanism 500 assumes the relationship of Inequality (5) with one of the sashes 104, 106 in a lowered position, and the other of the sashes 104, 106 held static or also lowered (e.g., a second independent operation mode). With one of the sashes 104, 106 held static or at the end of its travel in a direction opposed to the direction of travel of the moving sash, the counterbalance and assist mechanism 500 does not counterbalance the moving sash. Instead, the force input by the user (no longer counterbalanced and accordingly a factor) combines with the assistance provided by the counterbalance and assist mechanism 500 to move the sash and accordingly move the intermediate pulley 210 (e.g., since the opposed sash is held static or is moved in the same direction as the first moved sash). Accordingly, the force provided by the user overcomes the tension provided by the counterbalance and assist mechanism 500 to extend the intermediate pulley 210 during lowering of one or more of the sashes 104, 106.

As shown for each of the counterbalancing and independent operating modes, the sign of the block and tackle friction ($F_{BT}$) depends on lifting, lowering, or retention of one or more of the sashes 104, 106. The block and tackle friction provides resistance in the counterbalance mode to resist extension and retraction of the intermediate pulley 210, during lowering and raising of a sash, respectively. That is to say, the block and tackle friction attenuates the tension provided by the counterbalance and assist mechanism 500 as one of the sashes 104, 106 is raised, in the counterbalance mode, to prevent retraction of the intermediate pulley 210 and accordingly maintain the counterbalance. Similarly, the block and tackle friction enhances the tension provided by the counterbalance and assist mechanism 500 as one of the sashes 104, 106 is lowered, in the counterbalance mode, to prevent extension of the intermediate pulley 210 and maintain the counterbalance.

Optionally, with the use of the spring 520, the tension of the spring ($T_S$) is variable. In another example, the tension provided by the spring is assumed static (e.g., for the counterbalance and assist mechanism 200 described herein). Where the counterbalance and assist mechanism 500 is modeled with a variable $T_S$, one or more of the spring constant, length of the spring, and the like, can be modeled so that the intermediate pulley 210 is returned to its initial position (e.g., the initial intermediate pulley position 522 shown in FIGS. 5A and 6A) and maintained during counterbalancing operation. In this type of arrangement, the sashes 104, 106 would continue to operate in an independent operating mode, such as after release of the opposed sash and until the spring length of the spring 520 returns to an original length held constant during counterbalancing operation, for instance by returning the moved sash to a position opposed to the other sash. At that time, the mechanism will be in the counterbalance mode and the tension of the spring 520 will be static.

Figure 9:
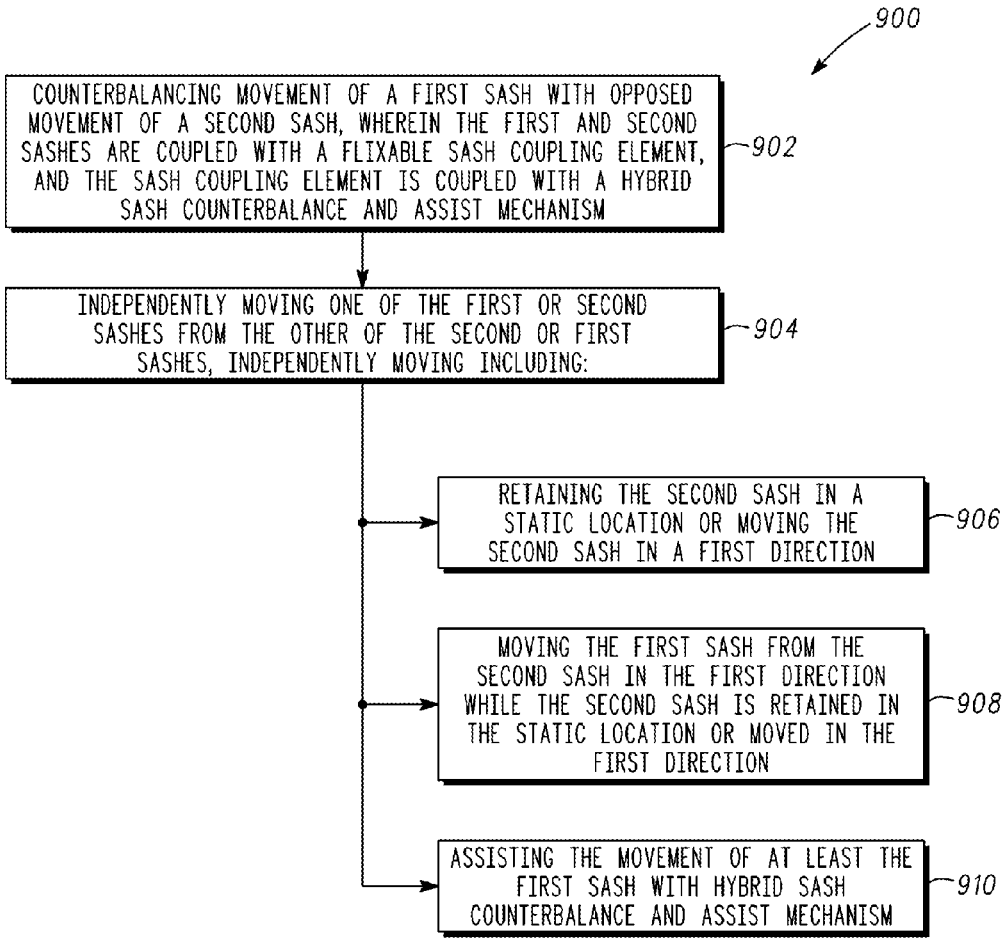
FIG. 9 is a block diagram illustrating an example that includes independently moving one of first and second sashes.

Referring now to FIG. 9, an example of a method 900 for counterbalancing and independently operating a window is provided, for instance, using the counterbalance and assist mechanisms 200, 500 described herein. In describing the method 900, reference is made to one or more components, features, functions, and the like, described herein. Where convenient, reference is made to the components and features with reference numerals. Reference numerals provided are exemplary and are not exclusive. For instance, the features, components, functions, and the like, described in the method 900 include the corresponding numbered elements other corresponding features described herein (both numbered and unnumbered) as well as their equivalents.

At 902, the method 900 includes counterbalancing movement of a first sash 104 with opposed movement of a second sash 106, wherein the first and second sashes 104, 106 are coupled using a sash coupling element (e.g., the sash coupling element 206). The sash coupling element 206 is coupled with a hybrid counterbalance and assist mechanism that provides counterbalancing and independent operation of the sashes 104, 106, for example, using one of the sash counterbalance and assist mechanisms 200, 500. In an example, the hybrid sash counterbalance and assist mechanism 200, 500 includes an intermediate pulley 210 coupled with the sash coupling element 206, and the pulley 210 is coupled with a block and tackle (e.g., the block and tackle 212), and a spring (e.g., the spring 220).

At 904, one of the first or second sashes 104, 106 is independently moved from the other of the sashes 104, 106 (e.g., one of the sashes is raised or lowered, and the other sash is held static or raised or lowered with the first sash). At 906, independently moving a first one of the sashes 104, 106 includes retaining the other sash in a static location, or moving the other sash in a first direction (e.g., in a direction opposite the movement of the first sash). At 908, the example 900 includes moving the first sash in the first direction while the second sash is retained in the static location or moved in the first direction.

At 910, the example 900 includes assisting the movement of at least the first sash using a hybrid sash counterbalance and assist mechanism (e.g., the counterbalance and assist mechanism 200, 500). That is, the hybrid sash counterbalance and assist mechanism 200, 500, can assist a user in raising or lowering a sash by reducing a necessary user-applied force to raise or lower the sash.

Several further options for the method 900 follow. In one example, the method 900 includes transitioning between an independent operating mode and a counterbalancing mode by releasing the second sash, wherein the second sash is free to move in a direction opposed to the movement direction of the first sash.

In another example, the method 900 includes retaining the intermediate pulley 210 of the hybrid sash counterbalance and assist mechanism (e.g., the counterbalance and assist mechanism 200, 500) in a static pulley location during counterbalancing. Optionally, the mechanism friction provided by the spring bias mechanism, such as by the block and tackle 212, cooperates with raising and lowering sashes to retain the intermediate pulley 210 in a static location (e.g., by attenuating or enhancing the tension provided by the counterbalance and assist mechanism 200 during raising and lowering of one or both of the sashes 104, 106). In an example, retaining the intermediate pulley 210 in the static pulley location includes attenuating a mechanism tension on the intermediate pulley 210 with a mechanism friction as one or more of the sashes is raised. In an example, retaining the intermediate pulley 210 in the static pulley location includes enhancing the mechanism tension on the intermediate pulley with the mechanism friction as one or more of the sashes is lowered.

In another example, the method 900 includes independently moving the first sash from the second sash, including retracting the intermediate pulley 210 as a first sash is raised, and extending the intermediate pulley 210 as the first sash is lowered.

Optionally, the method 900 includes fixing the intermediate pulley 210 of the hybrid sash counterbalance and assist mechanism 200, 500, in a static pulley location to prevent independently moving the first or second sash 104, 106. In another option, the hybrid sash counterbalance and assist mechanism includes an intermediate pulley 210 configured to translate (e.g., vertically) with corresponding independent movement of at least the first sash 104. In this example, the method 900 includes interrupting the translation of the intermediate pulley 210 (e.g., with a pin, fastener, stop, or the like). When the intermediate pulley 210 translation is interrupted, such as in at least one direction corresponding to raising or lowering of the first or second sash, independent movement of at least one of the sashes is permitted only with corresponding retracting or extending of the intermediate pulley 210.

Various Notes & Examples

Example 1 can include subject matter such as an apparatus, such as can include hybrid sash counterbalance and assist operated window with independently operable sashes comprising: a window frame having upper and lower sashes slidable within the window frame; a sash coupling element extending between the upper and lower sashes; a hybrid sash counterbalance and assist mechanism coupled with the sash coupling element, the hybrid sash counterbalance and assist mechanism is operable in a sash counterbalance mode and an independent sash movement mode, in the sash counterbalance mode, movement of the upper or lower sash causes converse movement of the lower or upper sash through the sash coupling element, and the movement of the upper or lower sash is assisted by the converse movement, and in a first independent sash movement mode, one of the upper and lower sashes is statically held while the other of the lower or upper sashes is moved, and the movement of the lower or upper sash is assisted by the hybrid sash counter balance and assist mechanism.

Example 2 can include, or can optionally be combined with the subject matter of Example 1, to optionally include a second independent sash movement mode, wherein the upper and lower sashes are raised.

Example 3 can include, or can optionally be combined with the subject matter of Example 1 or 2 to optionally include a second independent sash movement mode, wherein the upper and lower sashes are lowered.

Example 4 can include, or can optionally be combined with the subject matter of one or any combination of Examples 1 through 3 to optionally include the hybrid sash counter balance and assist mechanism with a spring bias element coupled with the upper and lower sashes.

Example 5 can include, or can optionally be combined with the subject matter of one or any combination of Examples 1-4 to optionally include the sash coupling element, including a flexible element coupled between the upper and lower sashes, and the spring bias element includes: an intermediate pulley coupled along the sash coupling element, a block and tackle including a first block, a second block and a flexible tackle element extending between the first and second blocks, and the flexible tackle element is coupled at a first tackle element end to the first block and at a second tackle element end to the intermediate pulley, and a spring coupled between the window frame and the first block.

Example 6 can include, or can optionally be combined with the subject matter of Examples 1-5 to optionally include the hybrid sash counter balance and assist mechanism to provide a mechanism friction, and the mechanism friction cooperates with a block and tackle mechanical advantage and the spring to immobilize the intermediate pulley in the sash counterbalance mode, and allow movement of the intermediate pulley in the first independent sash movement mode.

Example 7 can include, or can optionally be combined with the subject matter of Examples 1-6 to optionally include the mechanism friction cooperates with the block and tackle mechanical advantage and the spring to withdraw the intermediate pulley in the first independent sash movement mode.

Example 8 can include, or can optionally be combined with the subject matter of Examples 1-7 to optionally include one or more of the first or second blocks that provides the mechanism friction.

Example 9 can include, or can optionally be combined with the subject matter of one or any combination of Examples 1-8 to include, subject matter such as an apparatus, such as can include a hybrid sash counterbalance and assist operated window with independently operable sashes comprising: a window frame having upper and lower sashes slidable within the window frame; first and second guides coupled with the window frame; a sash coupling element extending between the upper and lower sashes and movably coupled along the first and second guides; and a hybrid sash counterbalance and assist mechanism coupled with the sash coupling element, the hybrid sash counterbalance and assist mechanism includes: an intermediate pulley movably coupled along the sash coupling element, a block and tackle, a flexible tackle element of the block and tackle includes first and second tackle element ends, the first tackle element end is coupled to the block and tackle, and the second tackle element end is coupled to the intermediate pulley, and a spring coupled between the window frame and the block and tackle.

Example 10 can include, or can optionally be combined with the subject matter of Examples 1-9 to optionally include first and second guide pulleys as the first and second guides, the first and second guide pulleys rotatably coupled with the window frame.

Example 11 can include, or can optionally be combined with the subject matter of Examples 1-10 to optionally include the intermediate guide pulley, wherein the intermediate guide pulley is interposed between the first and second guide pulleys, and the sash coupling element is movably coupled along the first guide pulley, the intermediate guide pulley and the second guide pulley in that order.

Example 12 can include, or can optionally be combined with the subject matter of Examples 1-11 to optionally include a stop, the stop selectively engageable with the intermediate pulley to hold the intermediate pulley in the static position.

Example 13 can include, or can optionally be combined with the subject matter of Examples 1-12 to optionally include the hybrid sash counterbalance and assist mechanism operable in a sash counterbalance mode and at least one independent sash movement mode.

Example 14 can include, or can optionally be combined with the subject matter of Examples 1-13 to optionally include wherein the hybrid sash and counterbalance mechanism provides a mechanism friction that retains the intermediate pulley in a static position as the upper and lower sashes are raised and lowered in the sash counterbalance mode.

Example 15 can include, or can optionally be combined with the subject matter of Examples 1-14 to optionally include the mechanism friction cooperating with sash weights, the block and tackle, and the spring, to balance forces incident on the intermediate pulley, such as to move the intermediate pulley toward the spring as one of the upper or lower sashes is raised or held static and as the other of the lower or upper sashes is raised in a first independent sash movement mode.

Example 16 can include, or can optionally be combined with the subject matter of Examples 1-15 to optionally include the mechanism friction cooperating with the sash weights, the block and tackle, and the spring to move the intermediate pulley away from the spring as one of the upper or lower sashes is lowered or held static and as the other of the lower or upper sashes is lowered.

Example 17 can include, or can optionally be combined with the subject matter of Examples 1-16 to optionally include wherein the hybrid sash and counterbalance mechanism to apply the mechanism friction to attenuate tension of the hybrid sash and counterbalance mechanism as at least one of the upper or lower sashes is raised, and the hybrid sash and counterbalance mechanism applies the mechanism friction to enhance tension of the hybrid sash and counterbalance mechanism as at least one of the upper or lower sashes is lowered.

Example 18 can include, or can optionally be combined with the subject matter of Examples 1-17 to optionally include, in the sash counterbalance mode, the sash coupling element extends along first, second and third cord lengths, the first cord length extending linearly from the upper sash to the first guide, the second cord length extending substantially linearly from the first guide to the second guide, and the third cord length extending linearly from the second guide to the lower sash.

Example 19 can include, or can optionally be combined with the subject matter of one or any combination of Examples 1-18 to include, subject matter such as a method, such as can include A method of counterbalancing and independently operating a window comprising: counterbalancing movement of a first sash with opposed movement of a second sash, wherein the first and second sashes are coupled with a flexible sash coupling element, and the sash coupling element is coupled with a hybrid sash counterbalance and assist mechanism; and independently moving one of the first or second sashes from the other of the second or first sashes, independently moving including: retaining the second sash in a static location or moving the second sash in a first direction, moving the first sash from the second sash in the first direction while the second sash is retained in the static location or moved in the first direction, and assisting the movement of at least the first sash with the hybrid sash counterbalance and assist mechanism.

Example 20 can include, or can optionally be combined with the subject matter of Examples 1-19 to optionally include transitioning between independently moving to counterbalancing by releasing the second sash, wherein the second sash is free to move in a direction opposed to the movement direction of the first sash.

Example 21 can include, or can optionally be combined with the subject matter of Examples 1-20 to optionally include retaining an intermediate pulley of the hybrid sash counterbalance and assist mechanism in a static pulley location during counterbalancing.

Example 22 can include, or can optionally be combined with the subject matter of Examples 1-21 to optionally include retaining the intermediate pulley in the static pulley location, including attenuating a mechanism tension on the intermediate pulley with a mechanism friction as one or more of the first or second sashes is raised, and enhancing the mechanism tension on the intermediate pulley with the mechanism friction as one or more of the first or second sashes is lowered.

Example 23 can include, or can optionally be combined with the subject matter of Examples 1-22 to optionally include wherein independently moving the first sash from the second sash, including retracting an intermediate pulley coupled with the flexible sash coupling element as the first sash is raised, and extending the intermediate pulley as the first sash is lowered.

Example 24 can include, or can optionally be combined with the subject matter of Examples 1-23 to optionally include fixing an intermediate pulley of the hybrid sash counterbalance and assist mechanism in a static pulley location to prevent independently moving the first sash or the second sash.

Example 25 can include, or can optionally be combined with the subject matter of Examples 1-24 to optionally include the hybrid sash counterbalance and assist mechanism, including an intermediate pulley configured to translate within independent movement of at least the first sash, and the method comprises interrupting the translation of the intermediate pulley in at least one direction corresponding to raising or lowering of the first or second sash during independent movement so that independent movement is only possible with one of retracting or extending of the intermediate pulley.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A window with upper and lower sashes that are movable relative to a frame of the window and each other, the window comprising:

a system selectively counterbalancing a raising or lowering movement of one of the sashes relative to the frame with a converse lowering or raising movement of the other one of the sashes such that the raising or lowering movement of the one sash causes the converse movement of the other sash, and assisting independent movement of one of the sashes relative to the other one of the sashes and the frame, the system including:

guide pulleys that rotate about respective axes, wherein the guide pulleys are disposed in the frame and the axes are static relative to the frame;

an intermediate pulley that rotates about an intermediate pulley axis; and a sash coupling element that extends between the upper and lower sashes of the window and engages the guide pulleys and the intermediate pulley, wherein the intermediate pulley is coupled with a portion of the sash coupling element that extends between the guide pulleys.

2. The window of claim 1, wherein the intermediate pulley axis is static with respect to the frame in a window counterbalance mode, and wherein the intermediate pulley axis is movable with respect to the frame in a sash assist mode.

3. The window of claim 1, wherein the system is in a window counterbalance mode when the raising or lowering of the one of the sashes causes the converse movement of the other one of the sashes, wherein, a position of the intermediate pulley axis is static with respect to the frame when the system is in the counterbalance mode.

4. The window of claim 3, wherein the system further includes a retainer configured to inhibit movement of the intermediate pulley axis with respect to the frame to maintain the system in the window counterbalance mode.

5. The window of claim 4, wherein the retainer is configured to be removable by a window user.

6. The window of claim 1, wherein the system further includes a block and tackle assembly configured to tension the sash coupling element, the block and tackle assembly including:

a spring coupled to the frame at a side portion of the frame that includes the guide pulleys;

a block coupled to the spring, the block being spaced apart from the guide pulleys; and a tackle element coupled to the block and the intermediate pulley.

7. The window of claim 1, wherein the system is in an independent sash movement mode when the independent movement of the one of the sashes occurs with respect to the other one of the sashes and the frame, wherein the intermediate pulley axis is movable with respect to the frame when the system is in the independent sash movement mode.

8. The window of claim 7, wherein the intermediate pulley axis is configured to move away from the guide pulleys when the system is in the independent sash movement mode.

9. The window of claim 1, wherein the raising or lowering movement of the one of the sashes causes the converse movement of the other one of the sashes through the sash coupling element, and wherein when the system assists the independent movement of the one of the sashes relative to the other one of the sashes and the frame, the other one of the sashes is static with respect to the window frame while the one of the sashes and the intermediate pulley axis are moved with respect to the window frame.

10. The window of claim 1, wherein the system further includes a block and tackle assembly configured to tension the sash coupling element, the block and tackle assembly including a spring, a block coupled to the spring, and a tackle element coupled to the block and the intermediate pulley, wherein tension in the spring is released as the intermediate pulley axis moves toward the block.

11. A system that assists movement of one of first and second sashes in an independent sash movement mode and that assists movement of both of the first and second sashes in a counterbalance sash movement mode, wherein the first and second sashes in a double-hung window assembly, the system comprising:

a sash coupling element coupled between the first and second sashes, the sash coupling element located at a side of a frame of the window assembly; and a pulley system coupled with the sash coupling element, the pulley system disposed at the side of the frame of the window assembly;

when the system is in the counterbalance sash movement mode, a movement of the first or second sash causes a converse movement of the second or first sash, respectively, through the sash coupling element, the converse movement of the second or first sash assists the movement of the first or second sash, respectively, and when the system is in the independent sash movement mode, the movement of the one of the sashes is assisted by the pulley system and the sash coupling element while the other one of the sashes is static with respect to the frame.

12. The system of claim 11, wherein the pulley system includes a pair of guide pulleys and an intermediate pulley, wherein the intermediate pulley is coupled with a portion of the sash coupling element that extends between the pair of guide pulleys.

13. The system of claim 11, wherein the system further includes a block and tackle assembly configured to tension the sash coupling element, the block and tackle assembly including:

a spring coupled to the frame at the side of the frame;

a block coupled to the spring, the block being spaced apart from the pulley system; and a tackle element coupled to the block and to the pulley system.

14. The system of claim 11, further comprising an intermediate pulley that rotates about an intermediate pulley axis, and wherein when the system is in the independent sash movement mode, the intermediate pulley axis moveable with respect to the frame.

* * * * *